US005112510A

United States Patent [19]

Rossi

[11] Patent Number: 5,112,510

[45] Date of Patent: May 12, 1992

[54] CARBOXYLATE POLYMER AND VISCOSITY INDEX IMPROVER CONTAINING OLEAGINOUS COMPOSITIONS

[75] Inventor: Albert Rossi, Warren, N.J.

[73] Assignee: Exxon Chemical Patents Inc., Linden, N.J.

[21] Appl. No.: 316,728

[22] Filed: Feb. 28, 1989

[51] Int. Cl.[5] ..... C10M 157/10

[52] U.S. Cl. ..... 252/56 R; 252/56 D

[58] Field of Search ..... 252/56 D, 56 R

[56] References Cited

U.S. PATENT DOCUMENTS

| | | | |
|---|---|---|---|
| 2,618,602 | 11/1952 | Bartlett | 252/56 |
| 2,655,479 | 10/1953 | Munday et al. | 252/56 |
| 2,824,840 | 2/1958 | Cashman et al. | 252/56 |
| 2,825,717 | 3/1958 | Cashman et al. | 260/78.5 |
| 3,048,479 | 8/1962 | Ilnyckyj et al. | 44/62 |
| 3,250,715 | 5/1966 | Wyman | 252/56 |
| 3,413,103 | 11/1968 | Young et al. | 44/62 |
| 3,522,180 | 7/1970 | Sweeney et al. | 252/59 |
| 3,726,653 | 4/1973 | Van der Meij et al. | 44/62 |
| 3,961,916 | 6/1976 | Ilnyckyj et al. | 44/62 |
| 3,981,850 | 9/1976 | Wisotsky et al. | 526/227 |
| 4,087,255 | 5/1978 | Wisotsky et al. | 44/62 |
| 4,088,589 | 5/1978 | Rossi et al. | 252/56 R |
| 4,153,422 | 5/1979 | Wisotsky | 44/62 |
| 4,153,423 | 5/1979 | Wisotsky | 44/62 |
| 4,153,424 | 5/1979 | Wisotsky | 44/62 |
| 4,210,424 | 7/1980 | Feldman et al. | 44/62 |
| 4,211,534 | 7/1980 | Feldman | 44/62 |
| 4,240,916 | 12/1980 | Rossi | 252/56 D |
| 4,261,703 | 4/1981 | Tack et al. | 44/62 |
| 4,514,314 | 4/1985 | Rossi | 252/56 D |
| 4,661,121 | 4/1987 | Lewtas | 44/70 |
| 4,661,122 | 4/1987 | Lewtas | 44/70 |
| 4,670,130 | 6/1987 | Dekraker et al. | 208/33 |
| 4,713,088 | 12/1987 | Tack et al. | 44/62 |
| 4,804,794 | 2/1989 | Ver Strate et al. | 585/12 |
| 4,839,074 | 6/1989 | Rossi et al. | 252/56 D |
| 4,863,486 | 9/1989 | Tack et al. | 44/62 |

FOREIGN PATENT DOCUMENTS

| | | |
|---|---|---|
| 0061895A2 | 10/1982 | European Pat. Off. . |
| 0153177 | 8/1985 | European Pat. Off. . |
| 0296714 | 12/1988 | European Pat. Off. . |
| 1263152 | 2/1972 | United Kingdom . |
| 1469016 | 3/1977 | United Kingdom . |
| 2023645A | 1/1980 | United Kingdom . |

*Primary Examiner*—Prince Willis, Jr.
*Assistant Examiner*—E. McAvoy
*Attorney, Agent, or Firm*—M. B. Kapustij; M. L. Alter; R. A. Maggio

[57] ABSTRACT

A lubricating oil composition exhibiting improved flow properties, specifically low temperature flow properties, and viscometric properties, particularly low temperature viscometric properties comprising lubricating oil and (i) an amount effective to improve the low temperature flow properties of said lubricating oil composition of additive consisting essentially of at least one low molecular weight non-ethylene containing polymer or interpolymer containing pendent ester groups comprising repeating methylene units derived from mixture of aliphatic alcohols, said mixture containing at least about 25 weight percent $C_{14}$ alcohol; and (ii) an amount effective to improve the viscosity index of said lubricating oil composition of additive comprising copolymer of ethylene and at least one other alpha-olefin monomer, said copolymer comprising intramolecularly heterogeneous copolymer chains containing at least one crystallizable segment of methylene units and at least one low crystallinity ethylene-alpha-olefin copolymer segment, wherein said at least one crystallizable segment comprises at least about 10 weight percent of said copolymer chain and contains an average ethylene content of at least about 57 weight percent, wherein said low crystallinity segment contains an average of not greater than about 53 weight percent ethylene, and wherein said copolymer has a molecular weight distribution characterized by at least one of a ratio of $\overline{M}_w/\overline{M}_n$ of less than 2 and a ratio of $\overline{M}_z/\overline{M}_w$ of less than 1.8, and wherein at least two portions of an individual intramolecularly heterogeneous chain, each portion comprising at least 5 weight percent of said chain, differ in composition from one another by at least 7 weight percent ethylene.

106 Claims, No Drawings

CARBOXYLATE POLYMER AND VISCOSITY INDEX IMPROVER CONTAINING OLEAGINOUS COMPOSITIONS

FIELD OF THE INVENTION

The present invention relates to additives for improving the flow properties and viscometric properties of certain oleaginous compositions and to oleaginous compositions containing said additives. More particularly, the present invention relates to additives for improving the low temperature flow properties and viscometric properties such as viscosity index of lubricating oil compositions and to lubricating oil compositions containing said additives. Still more particularly, the present invention relates to improved lubricating oil compositions including such additives and exhibiting improved low temperature flow properties and viscometric properties. The present invention also relates to methods for improving the flow properties and viscometric properties of oleaginous composition, particularly engine crankcase lubricant compositions.

BACKGROUND OF THE INVENTION

A wide variety of compounds for use as lubricating oil or fuel oil additives are known in this art. These include compounds variously referred to as pour point depressants, viscosity index improving compositions, wax crystal modifiers, and the like. In particular, Cashman et al., U.S. Pat. No. 2,825,717, discloses the preparation of certain lubricating oil additives by the copolymerization of polycarboxylic acid esters with other polymerizable monomeric materials, including vinyl compounds such as vinyl acetate. The preferred unsaturated polycarboxylic acid esters therein are fumaric acid esters produced from $C_1$ through $C_{18}$ aliphatic alcohols.

Bartlett, U.S. Pat. No. 2,618,602, discloses pour point depressing and/or viscosity index improving materials obtained by polymerizing certain specified alkyl fumarate esters. In particular this patentee discloses the use of polymerized fumarate esters of $C_{12}$ to $C_{14}$ alcohols for such purposes. This patent specifically discloses that the $C_{12}$ alcohol was more effective than the $C_{14}$ alcohol, although both polymerized esters exhibited pour point depressing properties.

Rossi et al., U.S. Pat. No. 4,089,589, discloses the use of specified mixtures of lubricating oil pour point depressants which include polyesters consisting of a polymeric ester of acrylic acid or methacrylic acid and a monohydric alcohol containing from 10 to 18 carbon atoms, and/or interpolymers of a vinyl alcohol ester of a $C_2$ to $C_{18}$ alkanoic acid (e.g., vinyl acetate) and a di($C_6$-$C_{18}$ alkyl) fumarate as one of the components thereof for improving the viscosity index of high wax content lubricating oils which also include viscosity index improving ethylene copolymers. Also, Wyman, U.S. Pat. No. 3,250,715, discloses terpolymers of dialkyl fumarates, vinyl esters, and alkyl vinyl ethers for improving the pour point of lubricating oils, and most particularly in which the dialkyl fumarates are prepared for various $C_{10}$ through $C_{18}$ alcohols including tetradecyl alcohol alone as well as alcohol mixtures averaging from 12 to 14 carbon atoms.

There has also been disclosed in co-pending U.S. patent applications Ser. Nos. 703,339 (now U.S. Pat. No. 4,713,088) and 703,340, both of which were filed on Feb. 20, 1985, the use in various middle distillate fuel compositions for lowering the pour point and controlling the size of wax crystals in these composition additives which specifically include polymers and copolymers of specific dialkyl fumarate vinyl acetate copolymers. Most specifically, these patent applications disclose the use of such additives in which the average number of carbon atoms in the alkyl groups in the polymer or copolymer must be from 12 to 14. In addition these additives are also disclosed as being useful in combination with the polyoxyalkylene esters, ethers, ester/ethers and mixtures thereof, as well as with various other additives. Furthermore, British Patent No. 2,023,645 discloses, for use in treating distillate fuel oils, various three-component systems which include as a first component flow improvers having an ethylene backbone, such as various ethylene polymers including ethylene polymerized with various mono- or diesters (e.g., vinyl acetate; and $C_{13}$ fumarates), as a second component a lube oil pour depressant such as various oil soluble esters and/or higher olefin polymers (e.g., dialkyl fumarate, vinyl acetate copolymers), and as a third component various polar oil-soluble compounds (e.g., phenates, sulfonates, phosphates, and carboxylates).

It is also disclosed in Lewtas's U.S. Pat. Nos. 4,661,121 and 4,661,122 that the size of wax crystals forming in fuels boiling in the range of 120° C. to 500° C. can be controlled by an additive which includes the polymers and copolymers of mono- and di-n-alkyl esters of mono-ethylenically unsaturated $C_4$ to $C_8$ mono- or dicarboxylic acids, in which the average number of carbon atoms in the n-alkyl groups is from 14 to 18. These patents show a preference for copolymers of di-n-alkyl fumarates and vinyl acetate, and specifically state that the fumarates can be made from single alcohols or mixtures of alcohols, and when mixtures are used they are mixed prior to esterification. Furthermore, these patents disclose the use of various ethylene unsaturated ester copolymer flow improvers as co-additives therewith, but do not specify that these additives are produced from alcohol mixtures. In co-pending U.S. Ser. No. 944,545, filed on Dec. 19, 1986, which is a Divisional of U.S. Ser. No. 589,536, filed on Mar. 14, 1984, there is disclosed as a dewaxing aid a copolymer of dialkyl fumarate and vinyl acetate in which a large proportion of the alkyl groups are $C_{20}$ to $C_{24}$ alkyl groups. In co-pending U.S. Ser. No. 53,698, filed on May 22, 1987, there is disclosed a dual component flow improver additive composition for oleaginous compositions which comprises (i) low molecular weight polymers and interpolymers (e.g., copolymers) of unsaturated mono- or dicarboxy esters having the formula

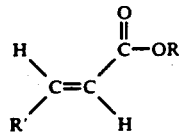

in which R' is either hydrogen or a COOR radical, and R is a $C_{14}$ alkyl group; and (ii) low molecular weight lubricating oil flow improver (LOFI) comprising non-ethylene containing polymers which are soluble or dispersable in these lubricating oils, preferably interpolymers of dialkyl fumarates and vinyl esters in which the fumarates are esterified with mixtures of $C_6$ through $C_{20}$ alcohols.

Various polymeric materials such as ethylene-alpha-olefin copolymers, e.g., ethylene-propylene copolymers, are known to be useful as viscosity index improvers for oleaginous compositions such as lubricating oils. U.S. Pat. No. 4,804,794 discloses ethylene-alpha-olefin polymeric compositions which provide oleaginous compositions, particularly lubricating oil compositions, exhibiting improved low temperature viscometric properties. These ethylene-alpha-olefin compositions comprise segmented copolymers which are intramolecularly heterogeneous and intermolecularly heterogeneous with at least one segment of the copolymer, constituting at least 10% of the copolymer's chain, being a crystallizable segment.

While these various types of additive compositions have met with various degrees of success in the particular environments in which they are employed it has been observed that various lubricating oil compositions, such as those containing certain viscosity improving additives such as copolymers of ethylene and propylene, as well as those lubricating oil compositions containing lubricating oil flow improvers, nevertheless experience difficulty in passing recently adopted, more stringent, low temperature, slow cool performance tests designed to measure the low temperature pumpability of crankcase lubricating oils. It is therefore an object of the present invention to provide oleaginous compositions, particularly lubricating oil compositions, which exhibit enhanced low temperature pumpability and viscometric properties.

SUMMARY OF THE INVENTION

In accordance with the present invention there is provided an oleaginous composition, particularly a lubricating oil composition, exhibiting improved low temperature flow properties and viscometric properties which comprises: (i) oleaginous material such as lubricating oil; (ii) a first additive or component which is a lubricating oil flow improver (LOFI) comprising low molecular weight non-ethylene containing polymer or interpolymer containing pendent ester groups, characterized by the presence within its structure of side chains of repeating methylene units derived from a mixture of alcohols; and (iii) a second additive or component which is a certain specific class of ethylene-alpha-olefin polymeric viscosity index improvers wherein the copolymers are segmented and are intramolecularly heterogeneous and intermolecularly homogeneous with at least one segment of the copolymer being a crystallizable segment having an ethylene content of at least 55% and constituting at least 10% of the copolymer's chain.

While the first additive or component may be a polymer or an interpolymer, in a preferred embodiment of the present invention, the first additive, i.e., lubricating oil flow improver (LOFI), comprises a low molecular weight, e.g., low number average molecular weight ($\overline{M}_n$), interpolymer of at least one unsaturated dicarboxylic acid or anhydride esterified with a mixture of $C_6$ through $C_{20}$ alcohols interpolymerized with a variety of different comonomers such as a polymerizable vinyl ester monomeric compound having the formula:

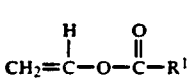

(I)

in which $R^1$ is an alkyl group containing from about 1 to 18 carbon atoms, preferably from about 1 to 6 carbon atoms, and most preferably 1 carbon atom. The preferred ester monomer of formula (I) is vinyl acetate.

The second additive, i.e., the viscosity index improver, comprises segmented copolymers of ethylene and at least one other alpha-olefin monomer; each copolymer is intramolecularly heterogeneous and intermolecularly homogeneous and at least 10% of the copolymer's chain, is a crystallizable segment. For the purposes of this application, the term "crystallizable segment" is defined to be each segment of the copolymer chain having a number-average molecular weight of at least 700 wherein the ethylene content is at least 55 wt. %. The remaining segments of the copolymer chain are herein termed the "low crystallinity segments" and are characterized by an average ethylene content of not greater than about 53 wt. %. Furthermore, the MWD of copolymer is very narrow. It is well known that the breadth of the molecular weight distribution (MWD) can be characterized by the ratios of various molecular weight averages. For example, an indication of a narrow MWD in accordance with the present invention is that the ratio of weight to number-average molecular weight ($\overline{M}_w/\overline{M}_n$) is less than 2. Alternatively, a ratio of the z-average molecular weight to the weight-average molecular weight ($\overline{M}_z/\overline{M}_w$) of less than 1.8 typifies a narrow MWD in accordance with the present invention. The viscosity index improver of the instant invention polymers are characterized by having at least one of $\overline{M}_w/\overline{M}_n$ less than 2 and $\overline{M}_z/\overline{M}_w$ less than 1.8. The copolymer comprises chains within which the ratio of the monomers varies along the chain length. To obtain the intramolecular compositional heterogeneity and narrow MWD, the copolymers in accordance with the present invention are preferably made in a tubular reactor.

DETAILED DESCRIPTION

The oleaginous compositions of the present invention comprise (i) oleaginous material, preferably lubricating oil, generally in a major amount; (ii) first additive comprised of low molecular weight lubricating oil flow improver (LOFI) comprising non-ethylene containing polymers or interpolymers which are soluble or dispersable in these oleaginous materials, preferably lubricating oils; and (iii) second additive comprised of a certain specific class of ethylene-alpha-olefin viscosity index improver.

The general term "lubricating oil flow improver" (LOFI) covers all those additives which modify the size, number, and growth of wax crystals in lube oils in such a way as to impart improved low temperature handling, pumpability, and/or vehicle operability as measured by such tests as pour point and mini rotary viscometry (MRV). The majority of lubricating oil flow improvers are polymers or contain polymers. These polymers are generally of two types, either backbone or sidechain.

The backbone variety, such as the ethylene-vinyl acetates (EVA), have various lengths of methylene segments randomly distributed in the backbone of the polymer, which associate or cocrystallize with the wax crystals inhibiting further crystal growth due to branches and non-crystallizable segments in the polymer.

The sidechain type polymers, which are the predominant variety used as LOFIs, have methylene segments as the side chains, preferably as straight side chains.

These polymers work similarly to the backbone type except the side chains have been found more effective in treating isoparaffins as well as n-paraffins found in lube oils. All the lubricating oil flow improvers of the second component of the present invention and as described hereinafter in connection with the second component fall into this latter category.

The first additive or component lubricating oil flow improvers of the present invention generally comprise long chain flow improving polymers or interpolymers of the sidechain type, which contain pendent ester groups derived from a mixture of alcohols whereby the alcohol residue can be characterized as repeating methylene units, and which are oil soluble, or dispersible, polymeric compositions that generally have low molecular weights (number average, as determined by vapor phase osmometry or membrane osmometry), i.e., not greater than about 40,000, and typically in the range of between about 1,500 and 40,000, and preferably between about 2,500 and 15,000.

Alternatively, such molecular weights of the first component lubricating oil flow improvers of the present invention are more conveniently expressed by the specific viscosity exhibited by such polymers. Accordingly, such specific viscosities will typically range from about 0.11 to about 2.2, preferably from about 0.2 to about 0.9, and most preferably from about 0.2 to about 0.7.

Such specific viscosities are determined in accordance with the following equation:

$$\text{Specific Viscosity} = \frac{\text{K-vis of Solution}}{\text{K-vis of Solvent}} - 1$$

wherein "K-vis of Solution" is the kinematic viscosity at 104° F. (40° C.) of a 2.0 mass/volume percent solution of the polymer (a.i.basis) in mixed xylenes (solvent) available commercially, using Ubbelohde-type viscometers with a viscometer constant of about 0.003 cSt/second; and the "K-vis of Solvent" is the corresponding kinematic viscosity of the solvent alone at the same temperature. All specific viscosities reported herein are determined by the above method.

One class of such lubricating oil flow improvers includes interpolymers, preferably copolymers of certain unsaturated dicarboxy esters with certain specified polymerizable monomeric compounds, namely, vinyl esters, alpha-olefins, or styrene.

Suitable ethylenically unsaturated dicarboxylic acids or their anhydrides, which are eventually esterified, with the hereinafter described mixture of alcohols, are monounsaturated, have the carboxyl or anhydride groups located on vicinal carbons (i.e., located on adjacent carbon atoms), have 4 to 10 carbons in the unesterified monomer molecule, and at least one, preferably both, of said adjacent carbon atoms are part of said monounsaturation. Suitable dicarboxylic acids or anhydrides thus include fumaric acid, maleic anhydride, maleic acid, mesaconic acid, citraconic acid and anhydride, and itaconic acid and its anhydride.

The particular dicarboxylic acid or anhydride monomer which is preferred will depend on the identity of its comonomer. Thus, when the comonomer is a vinyl ester, the preferred dicarboxylic acid is fumaric acid. When the comonomer is an alpha-olefin or styrene, the preferred dicarboxylic monomer is maleic anhydride.

Furthermore, whether it is preferable to esterify the dicarboxylic acid or anhydride monomer first and then interpolymerize, or to first interpolymerize the free acid or anhydride monomer and then esterify, depends on the particular identify of the dicarboxylic monomer and its comonomer.

Thus, for example, it is conventional to first esterify the fumaric acid monomer or any other dicarboxylic monomer, prior to interpolymerization with a vinyl ester.

In contrast, it is also conventional to polymerize maleic anhydride with styrene or the alpha-olefins, and to then esterify.

The nature of the alcohols used to esterify the dicarboxylic acid or anhydride, whether prior or subsequent to interpolymerization, is the same in all instances.

Moreover, while it is preferred to achieve complete esterification of all of the carboxyl groups of the dicarboxylic monomer, it is permissible to achieve only partial esterification, of typically not less than about 70, and preferably not less than about 80, mole % of the available esterifiable carboxyl groups.

Accordingly, esterification is conducted with mixtures of alcohols, which alcohols can be branched, preferably lightly branched, or straight chain, preferably straight chain. Thus, the alcohols used for esterification are typically selected from mixtures of $C_1$ to about $C_{20}$ aliphatic alcohols, preferably mixtures of about $C_6$ to about $C_{20}$ aliphatic alcohols, more preferably mixtures of $C_8$ to $C_{18}$ aliphatic alcohols and most preferably mixtures of $C_{10}$ to $C_{18}$ aliphatic alcohols. Primary alcohols are preferred over secondary and tertiary alcohols, and the alcohols are preferably saturated, although some degree of unsaturation (i.e., less than about 2 mole %) is permissible in various alcohol mixtures. Branched alcohols are preferred over straight and lightly branched chain alcohols.

The alcohols particularly selected for esterification should include sufficient hydrocarbon to insure oil solubility or dispersibility in the lubricating oils of the present invention, and thus mixtures of alcohols in the $C_4$ to $C_{20}$ average carbon number range are preferred, most particularly in the $C_8$ to $C_{18}$ range. In a more general sense, however, it is preferred to utilize a mixture of alcohols wherein the weight proportion, within said mixture, of alcohols containing an average carbon number between about $C_1$ and about $C_7$ can typically vary from about 0 to about 30, preferably less than about 10 weight %, based on the total weight of alcohols in said mixture, and correspondingly the weight portion, within said mixture, of alcohols containing an average carbon number between about $C_8$ and about $C_{18}$, can vary correspondingly from about 100 to about 70 (e.g., 100 to 75), preferably from about 100 to about 80, and most preferably from about 100 to about 90 weight % of the alcohols in said mixture.

Moreover, it is important that the alcohol mixture contain at least about 25, preferably at least about 27, more preferably at least about 30, and most preferably at least about 35 weight % of $C_{14}$ alcohols. Generally, the amount of $C_{14}$ alcohols (e.g., straight chain or slightly branched) present in the alcohol mixture should not exceed about 80, preferably about 75, more preferably about 70 weight %, and most preferably about 65.

These alcohol mixtures generally comprise mixtures of commercially available alcohol mixtures. These alcohol mixtures comprise, for example, mixtures of alcohols having from 8 to about 18 carbon atoms such as octyl alcohol, decyl alcohol, dodecyl alcohol, tetradecyl alcohol, pentadecyl alcohol, hexadecyl alcohol and octadecylalcohol. A particularly useful alcohol mixture is one comprised of a mixture of two commercially available alcohol mixtures. The first alcohol mixture comprises a mixture of $C_{10}$ to $C_{18}$ alcohols. More particularly, it comprises a mixture of decyl alcohol, dodecyl alcohol, tetradecyl alcohol, hexadecyl alcohol, and octadecyl alcohol. The second alcohol mixture is a commercial alcohol mixture comprised mainly of tetradecyl and pentadecyl alcohols. One source of this second mixture are the technical grade alcohols sold under the tradename NEODOLS by Shell Chemical Corporation. The second alcohol mixture comprised mainly of tetradecyl alcohol and pentadecyl alcohol is utilized in order to provide an alcohol mixture having the requisite $C_{14}$ alcohol content of at least about 25 weight %.

As indicated above, the dicarboxylic monomer can be interpolymerized with a variety of different comonomers, namely comonomers selected from vinyl esters, alpha-olefins, and styrene.

The first of these comonomers is a vinyl ester defined herein, to be represented by the following formula:

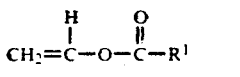

(I)

in which $R_1$ is an alkyl group containing from about 1 to 18 carbon atoms, preferably from about 1 to 6 carbon atoms, and most preferably 1 carbon atom, whereby the preferred ester monomer of formula (I) is vinyl acetate.

The preferred interpolymers of this class of lubricating oil flow improvers are $C_8$ to $C_{18}$, preferably $C_{10}$ to $C_{18}$, dialkyl fumarate/vinyl acetate copolymers wherein at least about 25, preferably at least about 27, more preferably at least 30, and most preferably at least about 35 percent of said alkyl groups are $C_{14}$ alkyl groups. In general, the amount of said $C_{14}$ alkyl groups present should not exceed about 80, preferably about 75, more preferably about 70, and most preferably about 60 wt. %. The dialkyl fumarate may be obtained by esterification of fumaric acid with a mixture of alcohol, preferably $C_8$ to $C_{18}$ alcohols, more preferably $C_{10}$ to $C_{18}$ alcohols, which mixture contains at least about 25, preferably at least about 27, more preferably at least about 30, and most preferably at least about 35 weight percent $C_{14}$ alcohols.

The mole ratio of the unsaturated dicarboxyl monomer to vinyl ester in the polymerization reaction mixture can vary typically from about 1.3:1 to 0.5:1, preferably from about 1.2:1 to 0.7:1, and most preferably from about 1.2:1 to 1:1.

Blends of two or more different dialkyl fumarate/vinyl acetate copolymers can be employed as the first component wherein each component of the blend is primarily distinguished by the carbon number of the alcohols initially employed to esterify the monomers of the individual copolymers. A preferred polymer blend is comprised of an equal weight mixture of a $C_8$ to $C_{18}$ dialkyl fumarate/vinyl acetate copolymer and a $C_{12}$ to $C_{18}$ dialkyl fumarate/vinyl acetate copolymer.

These interpolymers can be prepared by conventional free radical polymerization techniques, starting with a mixture of all of the constituent monomers which is essentially free of polymer. Thus the polymers are random interpolymers and are not graft or block interpolymers. Conventional free radical polymerization catalysts, such as azobis-(isobutyronitrile), tert-butyl hydroperoxide, and benzoyl peroxide, can be used. Such polymerization techniques can be conducted neat in the absence of solvent or in bulk.

Polymerization of the ester monomers is preferably carried out in an inert hydrocarbon solvent, such as hexane or heptane, or low viscosity lubricating oils. Polymerization is carried out in an oxygen-free reactor. The desired atmosphere can be maintained by carrying out the polymerization in a nitrogen atmosphere as is known in the art. Temperatures of about 65° to about 150° C., depending on the choice of initiator, can be used. Polymerization is carried out at either atmospheric or super-atmospheric pressure and on either a batch or a continuous basis. Polymerization can be stopped when the described degree of polymerization is reached by known techniques, such as adding inhibitors to the reaction mixture, or can be allowed to go to completion.

The second type of comonomer employed for interpolymerization with the unsaturated dicarboxyl monomer is an alpha-monoolefin. Straight chain alpha-olefins are preferred over branched chain alpha-olefins. Moreover, if branching occurs, it is preferred that it occur at the beta-carbon, and that such branching contain not more than about 5, and preferably not more than about 2, carbons. Suitable alpha-olefins typically contain between about 6 and 46, e.g., between about 10 and 22, and preferably about 18 carbon atoms per molecule. Mixtures of olefins may be used, e.g., a $C_{10}$–$C_{24}$ mixture.

Representative olefins include 1-hexene, 1-heptene, 1-nonene, 1-decene, 1-hexadecene, 1-octadecene, 1-eicosene, 1-heneicosene, 1-docosene, 1-tricontene, 1-tetracontene, 2-methyloctadecene, 2-ethyleicosene, and mixtures thereof.

The mole ratio of alpha-olefin to unsaturated dicarboxyl monomer employed in the reaction mixture will typically range from about 1.2:1 to about 0.8:1, preferably from about 1.1:1 to about 0.9:1, and most preferably about 1:1.

The preferred interpolymer of this class is an interpolymer of 1-octadecene and maleic anhydride subsequently esterified with the aforedescribed alcohols in the manner described hereinafter.

The third preferred comonomer for interpolymerization with the unsaturated dicarboxy monomer is styrene.

In forming this preferred unesterified intermediate polymer, the molar ratio of styrene to unsaturated dicarboxy-containing monomer (e.g., maleic anhydride) can typically vary from about 3:1 to about 1:1, preferably from about 2:1, to about 1:1, and most preferably from about 1.5:1 to about 1:1.

Most preferably, equal molar amounts of styrene and unsaturated carboxy containing monomer (e.g., maleic anhydride) are employed. In addition, minor amounts of other miscellaneous interpolymerizable comonomers can be included in the reaction mixture. By minor amount is typically meant less than about 1, preferably less than about 0.3 mole of miscellaneous monomers per mole of carboxy containing monomer. Similar considerations, vis-a-vis miscellaneous monomers, apply with respect to use of the alpha-olefins as a comonomer for interpolymerization with the dicarboxy monomer.

Various methods of polymerizing styrene or the alpha-olefins and the dicarboxy-containing monomers are known in the art and need not be discussed in detail herein. Such methods include neat and bulk polymerization techniques.

The polymerization reaction for use of either the styrene or alpha-olefin comonomers with the dicarboxy monomer is typically conducted to produce an unesterified interpolymer having a number average molecular weight of less than about 25,000, preferably less than about 15,000, as determined by membrane osmometry. Upon esterification, such molecular weights will be as described generally above as well as the corresponding specific viscosities.

The resulting interpolymer is then esterified with an alcohol mixture of the type described above with respect to esterification of the dicarboxy monomer.

The esterification reaction can be accomplished simply by heating the dicarboxy-containing polymer and the alcohol mixture under conditions typical for effecting esterification. Such conditions usually include, for example, a temperature of at least about 80° C., preferably from about 100° C. to about 150° C., provided that the temperature be below the decomposition point of the reaction mixture, and the water of esterification is removed as the reaction proceeds.

Such conditions may optionally include the use of an excess of the alcohol reactant so as to facilitate esterification, the use of a solvent or diluent such as mineral oil, toluene, benzene, xylene or the like, and the use of an esterification catalyst such as toluene sulfonic acid, sulfuric acid, phosphoric acid, or the like. These conditions and variations thereof are well known in the art.

Another class of lubricating oil flow improvers useful in accordance with the present invention comprises the polymers and interpolymers of unsaturated mono-esters, preferably polymers of long side chain unsaturated mono-esters, and interpolymers of long and short side chain unsaturated mono-esters. The unsaturated esters are generally acrylate or 2-alkylacrylate mono-esters represented by the formula:

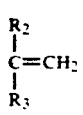

(II)

wherein $R_2$ is hydrogen or a $C_1$ to $C_5$ alkyl group; and $R_3$ is a $COOR_4$ group wherein $R_4$ is a $C_1$ to $C_{20}$, preferably a $C_{10}$ to $C_{18}$ alkyl group. A 2-alkylacrylate is one wherein $R_2$ is alkyl. The hydrocarbyl groups constituting $R_4$ represent the hydrocarbyl residues of mixtures of alcohols from which the same are prepared, which alcohols are preferably saturated, although some degree of unsaturation is permissible when mixtures of alcohols are employed, e.g., less than about 2 mole % of the alcohols in the mixture can be unsaturated. The mixtures of alcohols employed are those as described hereinafore.

Representative acrylate, and $C_1$ to $C_5$ 2-alkylacrylate monomers suitable for use in preparing the ester polymers and interpolymers of Formula (III), subject to the above carbon number average restrictions, include methyl acrylate, propyl methacrylate, propyl ethacrylate, octyl propacrylate, decyl butacrylate, dodecyl pentacrylate, hexyl methacrylate, octyl ethacrylate, decyl methacrylate, dodecyl methacrylate, tetradecyl methacrylate, hexadecyl methacrylate, octadecyl methacrylate, tridecyl acrylate, tetradecyl methacrylate, pentadecyl acrylate, hexadecyl acrylate, and octadecyl acrylate.

Most preferred acrylates or 2-alkyl acrylates are those containing $C_{12}$ to $C_{18}$ alkyl esters with at least about 25, preferably at least about 27, more preferably at least about 30, and most preferably at least about 35 % of said alkyl esters being $C_{14}$ alkyl esters. Generally, not more than about 80, preferably about 75, and more preferably about 70, and most preferably about 65 percent of said alkyl esters are $C_{14}$ alkyl esters.

The long chain aliphatic esters are those described in Formula (II) wherein $R_4$ may be prepared from mixed aliphatic alcohols containing from 10 to 20 carbon atoms per molecule. Saturated aliphatic alcohols containing from 12 to 18 carbon atoms per molecule, with at least about 20, preferably at least about 30, and more preferably at least about 35 mole percent of said alcohols containing 14 carbon atoms per molecule, are preferred.

Short chain unsaturated esters, having the above-noted Formula (II), but wherein $R_4$ has less than 10 carbons, preferably 1 to 5 carbons, in amounts of 5 to 50 molar percent, preferably 10 to 20 molar percent, based on the total polymer, can be copolymerized with the long chain unsaturated esters.

Preferably, all the alkyl esters in a given polymer will have the same acid moiety, e.g., the mixture of esters will be a mixture of acrylates or 2-alkyl acrylates (e.g., methacrylates).

The minimum number of carbon atoms of the $R_4$ substituent of the ester monomer is typically selected to avoid insolubility of the polymer in the lubricating oil, and the maximum number of carbon atoms therein is selected to avoid crystallization of the polymer out of the lubricating oil at low temperatures.

The polymers or interpolymers of Formula (II) are characterized by number average molecular weights and specific viscosities as described above.

The polymers and interpolymers of Formula (II) can be prepared by conventional free radical polymerization techniques, starting with a mixture of all of the constituent monomers which is essentially free of polymer. Thus, the polymers are random interpolymers and are not graft or block interpolymers. Conventional free radical polymerization catalysts, such as azobis-(isobutyronitrile), tertbutyl hydroperoxide, and benzoyl peroxide, can be used. Such polymerization techniques again include neat and bulk polymerization techniques.

Polymerization of the ester monomers is preferably carried out in an inert hydrocarbon solvent, such as hexane or heptane or low viscosity lubricating oil. Polymerization is carried out in an oxygen-free reactor. The desired atmosphere can be maintained by carrying out the polymerization in a nitrogen atmosphere as is known in the art. Temperatures of about 65° to about 120° C., depending on the choice of initiator, can be used. Polymerization is carried out at either atmospheric or super-atmospheric pressure and on either a batch or continuous basis. Polymerization can be stopped when the desired degree of polymerization is reached by known techniques, such as adding inhibitors to the reaction mixture, or can be allowed to go to completion.

The first additive or component compositions of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the first additive composition, for instance, is soluble or stably dispersible in oil to an extent sufficient to exert its intended effect in the environment in which the oil is employed. Moreover, the additional incorporation of other additives may also permit incorporation of higher levels of a particular first additive composition hereof, if desired.

The lubricating oil compositions of the present invention contain an amount of said first additive or component composition which is effective to improve the flow properties, particularly low temperature flow properties, of the lubricating oil composition, i.e., a lubricating oil flow improving effective amount. Generally, this effective amount may vary somewhat depending upon the type of oil. Accordingly, while any effective amount of the first additive composition can be incorporated into the final, e.g., fully formulated, lubricating oil composition, it is contemplated that such effective amount be sufficient to provide said lube oil composition with an amount of the first additive composition of typically from about 0.003 to about 1.5, preferably from about 0.005 to about 1.0, and more preferably from about 0.05 to about 0.5 wt. percent, based on the weight of said lubricating composition.

The second additive or component of the instant invention is a viscosity index improver or modifier comprised of specific type of segmented ethylene-alpha-olefin copolymer. Such copolymers are described in U.S. Pat. No. 4,804,794, which is incorporated herein by reference. These copolymers are segmented copolymers of ethylene and at least one other alpha-olefin monomer; each copolymer is intramolecularly heterogeneous and intermolecularly homogeneous and at least one segment of the copolymer, constituting at least 10% of the copolymer's chain, is a crystallizable segment. For the purposes of this application, the term "crystallizable segment" is defined to be each segment of the copolymer chain having a number-average molecular weight of at least 700 wherein the ethylene content is at least 55 wt. %. The remaining segments of the copolymer chain are herein termed the "low crystallinity segments" and are characterized by an average ethylene content of not greater than about 53 wt. %. Furthermore, the molecular weight distribution (MWD) of copolymer is very narrow. It is well known that the breadth of the molecular weight distribution can be characterized by the ratios of various molecular weight averages. For example, an indication of a narrow MWD in accordance with the present invention is that the ratio of weight to number-average molecular weight ($\overline{M}_w/\overline{M}_n$) is less than 2. Alternatively, a ratio of the z-average molecular weight to the weight-average molecular weight ($\overline{M}_z/\overline{M}_w$) of less than 1.8 typifies a narrow MWD in accordance with the present invention. It is known that a portion of the property advantages of the derivatized copolymers in accordance with the present invention are related to these ratios of the ethylene copolymer reactant. Small weight fractions of material can disproportionately influence these ratios while not significantly altering the property advantages which depend on them. For instance, the presence of a small weight fraction (e.g. 2%) of low molecular weight copolymer can depress $\overline{M}_n$, and thereby raise $\overline{M}_w/\overline{M}_n$ above 2 while maintaining $\overline{M}_z/\overline{M}_w$ less than 1.8. Therefore, polymers, in accordance with the present invention, are characterized by having at least one of $\overline{M}_w/\overline{M}_n$ less than 2 and $\overline{M}_z/\overline{M}_w$ less than 1.8. The copolymer comprises chains within which the ratio of the monomers varies along the chain length. To obtain the intramolecular compositional heterogeneity and narrow MWD, the copolymers are preferably made in a tubular reactor.

For convenience, certain terms that are repeated throughout the present specification are defined below:

a. Inter-CD defines the compositional variation, in terms of ethylene content, among polymer chains. It is expressed as the minimum deviation (analogous to a standard deviation) in terms of weight percent ethylene, from the average ethylene composition for a given copolymer sample needed to include a given weight percent of the total copolymer sample, which is obtained by excluding equal weight fractions from both ends of the distribution. The deviation need not be symmetrical. When expressed as a single number, for example 15% Inter-CD, it shall mean the larger of the positive or negative deviations. For example, for a Gaussian compositional distribution, 95.5% of the polymer is within 20 wt. % ethylene of the mean if the standard deviation is 10%. The Inter-CD for 95.5 wt. % of the polymer is 20 wt. % ethylene for such a sample.

b. Intra-CD is the compositional variation, in terms of ethylene, within a copolymer chain. It is expressed as the minimum difference in weight (wt. %) ethylene that exists between two portions of a single copolymer chain, each portion comprising at least 5 weight % of the chain.

c. Molecular weight distribution (MWD) is a measure of the range of molecular weights within a given copolymer sample. It is characterized in terms of at least one of the ratios of weight-average to number-average molecular weight, $\overline{M}_w/\overline{M}_n$, and z-average to weight-average molecular weight, $\overline{M}_z/\overline{M}_w$, where:

$$\overline{M}_w = \frac{\Sigma N_i M_i^2}{\Sigma N_i M_i}$$

$$\overline{M}_n = \frac{\Sigma N_i M_i}{\Sigma N_i}, \text{ and}$$

$$\overline{M}_z = \frac{\Sigma N_i M_i^3}{\Sigma N_i M_i^2}$$

wherein $N_i$ is the molecules of molecular weight $M_i$.

d. Viscosity Index (V.I.) is the ability of a lubricating oil to accommodate increases in temperature with a minimum decrease in viscosity. The greater this ability, the higher the V.I.

The instant copolymers are segmented copolymers of ethylene and at least one other alpha-olefin monomer wherein the copolymer's chain contains at least one crystallizable segment of ethylene monomer units, as will be more completely described below, and at least one low crystallinity ethylene-alpha-olefin copolymer segment, where in the low crystallinity copolymer segment is characterized in the unoriented bulk state after at least 24 hours annealing by a degree of crystallinity of less than about 0.2% at 23° C., and wherein the copolymer's chain is intramolecularly heterogeneous and intermolecularly homogeneous, and has an MWD characterized by at least one of $M_w/M_n$ of less than 2 and $\overline{M}_z/\overline{M}_w$ of less than 1.8. The crystallizable segments comprise from about 10 to 90 wt. %, preferably from about 20 to 85 wt. %, of the total copolymer chain, and contain an average ethylene content which is at least about 57 wt. %, preferably at least about 62 wt. %, and more preferably at least about 63 wt. % and which is not greater than 95 wt. %, more preferably <85%, and most preferably <75 wt. % (e.g., from about 58 to 68 wt. %). The low crystallinity copolymer segments comprise from about 90 to 10 wt. %, preferably from about 80 to 15 wt. %, and more preferably from about 65 to 35 wt. %, of the total copolymer chain, and contain an average ethylene content of from about 20 to 53 wt. %, preferably from about 30 to 50 wt. %, and more preferably from about 35 to 50 wt. %. The copolymers comprise intramolecularly heterogeneous chain segments wherein at least two portions of an individual intramolecularly heterogeneous chain, each portion comprising at least 5 weight percent of the chain and having a molecular weight of at least 7000 contain at least 5 wt. % ethylene and differ in composition from one another by at least 5 weight percent ethylene, wherein the intermolecular compositional dispersity of the polymer is such that 95 wt. % of the polymer chains have a composition 15% or less different in ethylene from the average weight percent ethylene composition, and wherein the copolymer is characterized by at least one or a ratio of $\overline{M}_w/\overline{M}_n$ of less than 2 and a ratio of $\overline{M}_z/\overline{M}_w$ of less than 1.8.

As described above, the copolymers will contain at least one crystallizable segment rich in methylene units (hereinafter called an "M" segment) and at least one low crystallinity ethylene-alpha-olefin copolymer segment (hereinafter called a "T" segment). The copolymers may be therefore illustrated by copolymers selected from the group consisting of copolymer chain structures having the following segment sequences:

$$M-T. \quad (I)$$

$$T^1-(M-T^2)_x, \text{ and} \quad (II)$$

$$T^1-(M^1-T^2)_y-M^2 \quad (III)$$

wherein M and T are defined above, $M^1$ and $M^2$ can be the same or different and are each M segments, $T^1$ and $T^2$ can be the same or different and are each T segments, x is an integer of from 1 to 3 and y is an integer of 1 to 3.

In structure II (x=1), the copolymer's M segment is positioned between two T segments, and the M segment can be positioned substantially in the center of the polymer chain (that is, the $T^1$ and $T^2$ segments can be substantially the same molecular weight and the sum of the molecular weight of the $T^1$ and $T^2$ segments can be substantially equal to the molecular weight of the M segment), although this is not essential to the practice of this invention. Preferably, the copolymer will contain only one M segment per chain. Therefore, structures I and II (x=1) are preferred.

Preferably, the M segments and T segments of the copolymer are located along the copolymer chain so that only a limited number of the copolymer chains can associate before the steric probiems associated with packing the low crystallinity T segments prevents further agglomeration. Therefore, in a preferred embodiment, the M segment is located near the center of the copolymer chain and only one M segment is in the chain.

As will be shown below, a copolymer of the structure $$M^1-(T-M^2)_z \quad (IV)$$

(wherein $M^1$, $M^2$ and T are as defined above, and wherein z is an integer of at least 1) are undesirable as viscosity modifier polymers. It has been found that solutions of structure IV copolymers in oil tend to gel even when the M and T portions have exactly the same composition and molecular weight as structure II copolymers (with x=z=1). It is believed this poor viscosity modifier performance is due to the inability of a center T segment to sterically stabilize against association.

The M segments of the copolymers of this invention comprise ethylene and can also comprise at least one other alpha-olefin, e.g., containing 3 to 18 carbon atoms. The T segments comprise ethylene and at least one other alpha-olefin, e.g., alpha-olefins containing 3 to 18 carbon atoms. The M and T segments can also comprise other polymerizable monomers, e.g., non-conjugated dienes or cyclic mono-olefins.

Since the present invention is considered to be most preferred in the context of ethylene-propylene (EPM) copolymers it will be described in detail in the context of EPM.

Copolymer (i)(a) in accordance with the present invention is preferably made in a tubular reactor. When produced in a tubular reactor with monomer feed only at the tube inlet, it is known at the beginning of the tubular reactor, ethylene, due to its high reactivity, will be preferentially polymerized. The concentration of monomers in solution changes along the tube in favor of propylene as the ethylene is depleted. The result, with monomer feed only at the inlet, is copolymer chains which are higher in ethylene concentration in the chain segments grown near the reactor inlet (as defined at the point at which the polymerization reaction commences), and higher in propylene concentration in the chain segments formed near the reactor outlet. These copolymer chains are therefore tapered in composition. An illustrative copolymer chain of ethylene-propylene is schematically presented below with E representing ethylene constituents and P representing propylene constituents in the chain:

$$\text{Segment: } \overbrace{E-E-E-E-P}^{1}-\overbrace{E-E-E-P-P}^{2}-\overbrace{E-E-P-P-P}^{3}-\overbrace{E-P-P-P-P}^{4}$$

As can be seen from this illustrative schematic chain, the far left-hand segment (1) thereof represents that portion of the chain formed at the reactor inlet where the reaction mixture is proportionately richer in the more reactive constituent ethylene. This segment comprises four ethylene molecules and one propylene molecule. However, as subsequent segments are formed from left to right with the more reactive ethylene being depleted and the reaction mixture proportionately increasing in propylene concentration, the subsequent chain segments become more concentrated in propylene. The resulting chain is intramolecularly heterogeneous.

The property, of the copolymer discussed herein, related to intramolecular compositional dispersity (compositional variation within a chain) shall be referred to as Intra-CD, and that related to intermolecular compositional dispersity (compositional variation between chains) shall be referred to as Inter-CD.

For copolymers in accordance with the present invention, composition can vary between chains as well as along the length of the chain. An object of this invention is to minimize the amount of inter-chain variation. The Inter-CD can be characterized by the difference in composition between the copolymer fractions containing the highest and lowest quantity of ethylene. Techniques for measuring the breadth of the Inter-CD are known as illustrated in "Polymerization of ethylene and propylene to amorphous copolymers with catalysts of vanadium oxychloride and alkyl aluminum halides"; E. Junghanns, A. Gumboldt and G Bier; Makromol. Chem., V. 58 (12/12/62): 18-42, wherein a p-xylene/-dimethylformamide solvent/non-solvent was used to fractionate copolymer into fractions of differing intermolecular composition. Other solvent/non-solvent systems can be used as hexane/2 propanol, as will be discussed in more detail below.

The Inter-CD of copolymer in accordance with the present invention is such that 95 wt. % of the copolymer chains have an ethylene composition that differs from the average weight percent ethylene composition by 15 wt. % or less. The preferred Inter-CD is about 13% or less, with the most preferred being about 10% or less. In comparison, Junghanns et al. found that their tubular reactor copolymer had an Inter-CD of greater than 15 wt. %.

Broadly, the Intra-CD of copolymer in accordance with the present invention is such that at least two portions of an individual intramolecularly heterogeneous chain, each portion comprising at least 5 weight percent of the chain, differ in composition from one another by at least 7 weight percent ethylene. Unless otherwise indicated, this property of Intra-CD as referred to herein is based upon at least two 5 weight percent portions of copolymer chain. The Intra-CD of copolymer in accordance with the present invention can be such that at least two portions of copolymer chain differ by at least 10 weight percent ethylene. Differences of at least 20 weight percent, as well as, of at least 40 weight percent ethylene are also considered to be in accordance with the present invention.

The experimental procedure for determining Intra-CD is as follows. First the Inter-CD is established as described below, then the polymer chain is broken into fragments along its contour and the Inter-CD of the fragments is determined. The difference in the two results is due to Intra-CD as can be seen in the illustrative example below.

Consider a heterogeneous sample polymer containing 30 monomer units. It consists of 3 molecules designated A, B, C.

A EEEEPEEEPEEEPPEEPPEPPPEPPPPPPP

B EEEEEPEEEPEEEPPEEEPPPEPPPEEPPP

C EEPEEEPEEEPEEEPEEEPPEEPPPEEPPP

Molecule A is 36.8 wt. % ethylene, B is 46.6%, and C is 50% ethylene. The average ethylene content for the mixture is 44.3%. For this sample the Inter-CD is such that the highest ethylene polymer contains 5.7% more ethylene than the average while the lowest ethylene content polymer contains 7.5% less ethylene than the average. Or, in other words, 100 weight % of the polymer is within +5.7% and −7.5% ethylene about an average of 44.3%. Accordingly, the Inter-CD is 7.5% when the given weight % of the polymer is 100%.

If the chains are broken into fragments, there will be a new Inter-CD. For simplicity, consider first breaking only molecule A into fragments shown by the slashes as follows:

EEEEP/EEEPE/EEPPE/EPPEP/-
PPEPP/PPPPP

Portions of 72.7%, 72.7%, 50%, 30.8%, 14.3% and 0% ethylene are obtained. If molecules B and C are similarly broken and the weight fractions of similar composition are grouped a new Inter-CD is obtained.

In order to determine the fraction of a polymer which is intramolecularly heterogeneous in a mixture of polymers combined from several sources the mixture must be separated into fractions which show no further heterogenity upon subsequent fractionation. These fractions are subsequently fractured and fractionated to reveal which are heterogeneous.

The fragments into which the original polymer is broken should be large enough to avoid end effects and to give a reasonable opportunity for the normal statistical distribution of segments to form over a given monomer conversion range in the polymerization. Intervals of ca 5 weight % of the polymer are convenient. For example, at an average polymer molecular weight of about 105, fragments of ca 5000 molecular weight are appropriate. A detailed mathematical analysis of plug flow or batch polymerization indicates that the rate of change of composition along the polymer chain contour will be most severe at high ethylene conversion near the end of the polymerization. The shortest fragments are needed here to show the low ethylene content sections.

The best available technique for determination of compositional dispersity for non-polar polymers is solvent/non-solvent fractionation which is based on the thermodynamics of phase separation. This technique is described in "Polymer Fractionation", M. Cantow editor, Academic 1967, p. 341 and in H. Inagaki, T. Tanaku, "Developments in Polymer Characterization", 3, 1, (1982). These are incorporated herein by reference.

For non-crystalline copolymers of ethylene and propylene, molecular weight governs insolubility more than does composition in a solvent/non-solvent solution. High molecular weight polymer is less soluble in a given solvent mix. Also, there is a systematic correlation of molecular weight with ethylene content for the polymers described herein. Since ethylene polymerizes much more rapidly than propylene, high ethylene polymer also tends to be high in molecular weight. Additionally, chains rich in ethylene tend to be less soluble in hydrocarbon/polar non-solvent mixtures than propylene-rich chains. Furthermore, for crystalline segments, solubility is significantly reduced. Thus, the high molecular weight, high ethylene chains are easily separated on the basis of thermodynamics.

A fractionation procedure is as follows: Unfragmented polymer is dissolved in n-hexane at 23° C. to form ca a 1% solution (1 g. polymer/100 cc hexane). Isopropyl alcohol is titrated into the solution until turbidity appears at which time the precipitate is allowed to settle. The supernatant liquid is removed and the precipitate is dried by pressing between Mylar polyethylene terphthalate) film at 150° C. Ethylene content is determined by ASTM method D-3900. Titration is resumed and subsequent fractions are recovered and analyzed until 100% of the polymer is collected. The titrations are ideally controlled to produce fractions of 5-10% by weight of the original polymer, especially at the extremes of composition.

To demonstrate the breadth of the distribution, the data are plotted as % ethylene versus the cumulative weight of polymer as defined by the sum of half the weight % of the fraction of that composition plus the total weight % of the previously collected fractions.

Another portion of the original polymer is broken into fragments. A suitable method for doing this is by thermal degradation according to the following procedure: In a sealed container in a nitrogen-purged oven, a 2 mm thick layer of the polymer is heated for 60 minutes at 330° C. (The time or temperature can be empirically adjusted based on the ethylene content and molecular weight of the polymer.) This should be adequate to reduce a 105 molecular weight polymer to fragments of ca 5000 molecular weight. Such degradation does not substantially change the average ethylene content of the polymer, although propylene tends to be lost on scission in preference to ethylene. This polymer is fractionated by the same procedure as the high molecular weight precursor. Ethylene content is measured, as well as molecular weight on selected fractions.

The procedure to characterize intramolecular heterogeneity is laborious and even when performed at an absolute optimum, does not show how the segments of the chain are connected. In fact it is not possible, with current technology, to determine the polymer structure without recourse to the synthesis conditions. With knowledge of the synthesis conditions, the structure can be defined as follows.

Ethylene, propylene or high alpha-olefin polymerizations with transition metal catalysts can be described by the terminal copolymerization model, to an approximation adequate for the present purpose. (G. Ver Strate, *Encyclopedia of Polymer Science and Engineering*, vol. 6, 522 (1986)). In this model, the relative reactivity of the two monomers is specified by two reactivity ratios defined as follows:

$$R_1 = \frac{\text{(rate constant for ethylene adding to ethylene)}}{\text{(rate constant for propylene adding to ethylene)}}$$

$$R_2 = \frac{\text{(rate constant for propylene adding to propylene)}}{\text{(rate constant for ethylene adding to propylene)}}$$

Given these two constants, at a given temperature, the ratio of the molar amount of ethylene, E, to the molar amount of propylene, P, entering the chain from a solution containing ethylene and propylene at molar concentrations [E] and [P] respectively is $$\frac{E = [E]}{P = [P]} \cdot \frac{(R_1[E] + [P])}{([E] + R_2[P])} \quad (1)$$

The relation of E and P to the weight % ethylene in the polymer is as follows $$\text{weight \% ethylene} = \frac{E}{E + 1.5\,P} \cdot 100$$

The values of $R_1$ and $R_2$ are dependent on the particular comonomer and catalyst employed to prepare the polymer, the polymerization temperature and, to some extent, the solvent.

For all transition metal catalysts specified herein, $R_1$ is significantly larger than $R_2$. Thus, as can be seen from equation (1), ethylene will be consumed more rapidly than propylene for a given fraction of the monomer in the reacting medium. Thus, the ratio of [E]/[P] will decrease as the monomers are consumed. Only if $R_1 = R_2$ will the composition in the polymer equal that in the reacting medium.

If the amount of monomer that has reacted at a given time in a batch reactor or at a given point in a tubular reactor can be determined, it is possible through equation (1), to determine the instantaneous composition being formed at a given point along the polymer chain. Demonstration of narrow MWD and increasing MW along the tube proves the compositional distribution is intramolecular. The amount of polymer formed can be determined in either of two ways. Samples of the polymerizing solution may be collected, with appropriate quenching to terminate the reaction at various points along the reactor, and the amount of polymer formed evaluated. Alternatively, if the polymerization is run adiabatically and the heat of polymerization is known, the amount of monomer converted may be calculated from the reactor temperature profile.

Finally, if the average composition of the polymer is measured at a series of locations along the tube, or at various times in the batch polymerization case, it is possible to calculate the instantaneous composition of the polymer being made. This technique does not require knowledge of $R_1$ and $R_2$ or the heat of polymerization, but it does require access to the polymer synthesis step.

All of these methods have been employed with consistent results.

For the purpose of this patent, $R_1$ and $R_2$ thus simply serve to characterize the polymer composition in terms of the polymerization conditions. By defining $R_1$ and $R_2$, we are able to specify the intramolecular compositional distribution. In the examples shown below where $VCl_4$ and ethylaluminum sesquichloride are employed in hexane as solvent, $R_1 = 1.8\exp(+500/RT_k)$ and $R_2 = 3.2\exp(-1500/RT_k)$. Where "R" is the gas constant (1.98 col/deg-mole) and "$T_k$" is degrees Kelvin. For reference, at 20° C. $R_1 = 9.7$, $R_2 = 0.02$.

The $R_1$ and $R_2$ given above predict the correct final average polymer composition. If the $R_1$ and $R_2$ and expression (2) are someday proven to be inaccurate the polymer intramolecular compositional distribution will remain as defined herein in terms of the polymerization conditions but may have to be modified on the absolute composition scales. There is little likelihood that they are in error by more than a few percent, however.

Ethylene content is measured by ASTM-D3900 for ethylene-propylene copolymers between 35 and 85 wt. % ethylene. Above 85% ASTM-D2238 can be used to obtain methyl group concentrations which are related to percent ethylene in an unambiguous manner for ethylene-propylene copolymers. When comonomers other than propylene are employed no ASTM tests covering a wide range of ethylene contents are available; however, proton and carbon-13 nuclear magnetic reasonance spectroscopy can be employed to determine the composition of such polymers. These are absolute techniques requiring no calibration when operated such that all nucleii of a given element contribute equally to the spectra. For ranges not covered by the ASTM tests for ethylene-propylene copolymers, these nuclear magnetic resonance methods can also be used.

Molecular weight and molecular weight distribution are measured using a Waters 150C gel permeation chromatography equipped with a Chromatix KMX-6 (LDC-Milton Roy, Riviera Beach, Fla.) on-line light scattering photometer. The system is used at 135° C. with 1,2,4 trichlorobenzene as mobile phase. Showdex (Showa-Denko America, Inc.) polystyrene gel columns 802, 803, 804 and 805 are used. This technique is discussed in "Liquid Chromatography of Polymers and Related Materials III", J. Cazes editor. Marcel Dekker, 1981, p. 207 (incorporated herein by reference). No corrections for column spreading are employed; however, data on generally accepted standards, e.g., National Bureau of Standards Polyethlene 1484 and anionically produced hydrogenated polyisoprenes (an alternating ethylene-propylene copolymer) demonstrate that such corrections on $\overline{M}_w/\overline{M}_n$ or $\overline{M}_z/\overline{M}_w$ are less than 0.05 unit. $\overline{M}_w/\overline{M}_n$ is calculated from an elution time-molecular weight relationship whereas $\overline{M}_z/\overline{M}_w$ is evaluated using the light scattering photometer. The numerical analyses can be performed using the commercially available computer software GPC2, MOLWT2 available from LDC/Milton Roy-Riviera Beach, Fla.

As already noted, copolymers in accordance with the present invention are comprised of ethylene and at least one other alpha-olefin. It is believed that such alpha-olefins could include those containing 3 to 18 carbon atoms, e.g., propylene, butene-1, pentene-1, etc. Alpha-olefins of 3 to 6 carbons are preferred due to economic considerations. The most preferred copolymers in accordance with the present invention are those comprised of ethylene and propylene.

As is well known to those skilled in the art, copolymers of ethylene and higher alpha-olefins such as propylene often include other polymerizable monomers. Typical of these other monomers may be non-conjugated dienes such as the following non-limiting examples:

a. straight chain acyclic dienes such as: 1,4-hexadiene; 1,6-octadiene;

b. branched chain acyclic dienes such as: 5-methyl-1,4-hexadiene; 3, 7-dimethyl-1,6-octadiene; 3, 7-dimethyl-1,7-octadiene and the mixed isomers of dihydro-myrcene and dihydroocinene;

c. single ring alicyclic dienes such as: 1,4-cyclohexadiene; 1,5-cyclooctadiene; and 1,5-cyclododecadiene;

d. multi-ring alicyclic fused and bridged ring dienes such as: tetrahydroindene; methyltetrahydroindene; dicyclopentadiene; bicyclo-(2,2,1)-hepta-2, 5-diene; alkenyl, alkylidene, cycloalkenyl and cycloalkylidene norbornenes such as 5-methylene-2-norbornene (MNB), 5-ethylidene-2-norbornene (ENB), 5-propylene-2-norbornene, 5-isopropylidene-2-norbornene, 5-(4-cyclopentenyl)-2-norbornene; 5-cyclohexylidene-2-norbornene.

Of the non-conjugated dienes typically used to prepare these copolymers, dienes containing at least one of the double bonds in a strained ring are preferred. The most preferred diene is 5-ethylidene-2-norbornene (ENB). The amount of diene (wt. basis) in the copolymer could be from about 0% to 20% with 0% to 15% being preferred. The most preferred range is 0% to 10%.

As already noted, the most preferred copolymer in accordance with the present invention is ethylene-propylene. The average ethylene content of the copolymer could be as low as about 20% on a weight basis. The preferred minimum is about 25%. A more preferred minimum is about 30%. The maximum ethylene content could be about 90% on a weight basis. The preferred maximum is about 85%, with the most preferred being about 80%. Preferably, the copolymers of this invention intended for use as viscosity modifier-dispersant contain from about 35 to 75 wt. % ethylene, and more preferably from about 50 to 70 wt. % ethylene.

The molecular weight of copolymer made in accordance with the present invention can vary over a wide range. It is believed that the weight-average molecular weight could be as low as about 2,000. The preferred minimum is about 10,000. The most preferred minimum is about 20,000. It is believed that the maximum weight-average molecular weight could be as high as about 12,000,000. The preferred maximum is about 1,000,000. The most preferred maximum is about 750,000. An especially preferred range of weight-average molecular weight for copolymers intended for use as V.M. polymer is from 50,000 to 500,000.

The copolymers of this invention will also be generally characterized by a Mooney viscosity (i.e., ML(1,+4,) 125° C.) of from about 1 to 100, preferably from about 5 to 70, and more preferably from about 8 to 65, and by a thickening efficiency ("TE") of from about 0.4 to 5.0, preferably from about 1.0 to 4.5, most preferably from about 1.4 to 4.0.

Another feature of copolymer of the present invention is that the molecular weight distribution (MWD) is very narrow, as characterized by at least one of a ratio of $\overline{M}_w/\overline{M}_n$ of less than 2 and a ratio of $\overline{M}_z/\overline{M}_w$ of less than 1.8. As relates to EPM and EPDM, a typical advantage of such copolymers having narrow MWD is resistance to shear degradation. Particularly for oil additive applications, the preferred copolymers have $\overline{M}_w/\overline{M}_n$ less than about 1.5, with less than about 1.25 being most preferred. The preferred $\overline{M}_z/\overline{M}_w$ is less than about 1.5, with less than about 1.2 being most preferred.

The copolymers of the instant invention may be produced by polymerization of a reaction mixture comprised of catalyst, ethylene and at least one additional alpha-olefin monomer, wherein the amounts of monomer, and preferably ethylene, is varied during the course of the polymerization in a controlled manner as will be hereinafter described. Solution polymerizations are preferred.

Any known solvent for the reaction mixture that is effective for the purpose can be used in conducting solution polymerizations in accordance with the present invention. For example, suitable solvents would be hydrocarbon solvents such as aliphatic, cycloaliphatic and aromatic hydrocarbon solvents, or halogenated versions of such solvents. The preferred solvents are $C_{12}$ or lower, straight chain or branched chain, saturated hydrocarbons, $C_5$ to $C_9$ saturated alicyclic or aromatic hydrocarbons or $C_2$ to $C_6$ halogenated hydrocarbons. Most preferred are $C_{12}$ or lower, straight chain or branched chain hydrocarbons, particularly hexane. Non-limiting illustrative examples of solvents are butane, pentane, hexane, heptane, cyclopentane, cyclohexane, cycloheptane, methyl cyclopentane, methyl cyclohexane, isooctane, benzene, toluene, xylene, chloroform, chlorobenzenes, tetrachloroethylene, dichloroethane and trichloroethane.

These polymerizations are carried out in a mix-free reactor system, which is one in which substantially no mixing occurs between portions of the reaction mixture that contain polymer chains initiated at different times. Suitable reactors are a continuous flow tubular or a stirred batch reactor. A tubular reactor is well known and is designed to minimize mixing of the reactants in the direction of flow. As a result, reactant concentration will vary along the reactor length. In contrast, the reaction mixture in a continuous flow stirred tank reactor (CFSTR) is blended with the incoming feed to produce a solution of essentially uniform composition everywhere in the reactor. Consequently, the growing chains in a portion of the reaction mixture will have a variety of ages and thus a single CFSTR is not suitable for the process of this invention. However, it is well known that 3 or more stirred tanks in series with all of the catalyst fed to the first reactor can approximate the performance of a tubular reactor. Accordingly, such tanks in series are considered to be in accordance with the present invention.

A batch reactor is a suitable vessel, preferably equipped with adequate agitation, to which the catalyst, solvent, and monomer are added at the start of the polymerization. The charge of reactants is then left to polymerize for a time long enough to produce the desired product or chain segment. For economic reasons, a tubular reactor is preferred to a batch reactor for carrying out the processes of this invention.

In addition to the importance of the reactor system to make copolymers in accordance with the present invention, the polymerization should be conducted such that:

(a) the catalyst system produces essentially one active catalyst species, (b) the reaction mixture is essentially free of chain transfer agents, and (c) the polymer chains are essentially all initiated simultaneously, which is at the same time for a batch reactor or at the same point along the length of the tube for a tubular reactor.

To prepare copolymer structures II and III above (and, optionally, to prepare copolymer structure I above), additional solvent and reactants (e.g., at least one of the ethylene, alpha-olefin and diene) will be added either along the length of a tubular reactor or during the course of polymerization in a batch reactor, or to selected stages of stirred reactors in series in a controlled manner (as will be hereinafter described) to form the copolymers of this invention. However, it is necessary to add essentially all of the catalyst at the inlet of the tube or at the onset of batch reactor operation to meet the requirement that essentially all polymer chains are initiated simultaneously.

Accordingly, polymerization in accordance with the present invention are carried out:

(a) in at least one mix-free reactor, (b) using a catalyst system that produces essentially one active catalyst species, (c) using at least one reaction mixture which is essentially transfer agent-free, and (d) in such a manner and under conditions sufficient to initiate propagation of essentially all polymer chains simultaneously.

Since the tubular reactor is the preferred reactor system for carrying out polymerizations in accordance with the present invention, the following illustrative descriptions are drawn to that system, but will apply to other reactor systems as will readily occur to the artisan having the benefit of the present disclosure.

In practicing polymerization processes in accordance with the present invention, use is preferably made of at least one tubular reactor. Thus, in its simplest form, such a process would make use of but a single, reactor. However, as would readily occur to the artisan having the benefit of the present disclosure, a series of reactors could be used with multiple monomer feed to vary intramolecular composition as described below.

The composition of the catalyst used to product alpha-olefin copolymers has a profound effect on copolymer product properties such as compositional dispersity and MWD. The catalyst utilized in practicing processes in accordance with the present invention should be such as to yield essentially one active catalyst species in the reaction mixture. More specifically, it should yield one primary active catalyst species which provides for substantially all of the polymerization reaction. Additional active catalyst species could provide as much as 35% (weight) of the total copolymer. Preferably, they should account for about 10% or less of the copolymer. Thus, the essentially one active species should provide for at least 65% of the total copolymer produced, preferably for at least 90% thereof. The extend to which a catalyst species contributes to the polymerization can be readily determined using the below-described techniques for characterizing catalyst according to the number of active catalyst species.

Techniques for characterizing catalyst according to the number of active catalyst species are within the skill of the art, as evidenced by an article entitled "Ethylene-Propylene Copolymers. Reactivity Ratios, Evaluation and Significance", C. Cozewith and G. Ver Strate, *Macromolecules*, 4, 482 (1971), which is incorporated herein by reference.

It is disclosed by the authors that copolymers made in a continuous flow stirred reactor should have an MWD characterized by $\overline{M}_w/\overline{M}_n=2$ and a narrow Inter-CD when one active catalyst species is present. By a combination of fractionation and gel permeation chromatography (GPC) it is shown that for single active species catalysts the compositions of the fractions vary no more than ±3% about the average and the MWD (weight- to number-average ratio) for these samples approaches 2. It is this latter characteristic ($\overline{M}_w/\overline{M}_n$ of about 2) that is deemed the more important in identifying a single active catalyst species. On the other hand, other catalysts gave copolymer with an Inter-CD greater than ±10% about the average and multi-modal MWD often with $\overline{M}_w/\overline{M}_n$ greater than 10. These other catalysts are deemed to have more than one active species.

Catalyst systems to be used in carrying out processes in accordance with the present invention may be Ziegler catalysts, which may typically include:

(a) a compound of a transition metal, i.e., a metal of Groups I-B, III-B, IVB, VB, VIB, and VIII of the Periodic Table, and (b) an organometal compound of a metal of Groups I-A, II-A, II-B, and III-A of the Periodic Table.

The preferred catalyst system in practicing processes in accordance with the present invention comprises hydrocarbon-soluble vanadium compound in which the vanadium valence is 3 to 5 and an organo-aluminum compound, with the proviso that the catalyst yields essentially one active catalyst species as described above. At least one of the vanadium compound/organo-aluminum pair selected must also contain a valence-bonded halogen.

In terms of formulas, vanadium compounds useful in practicing processes in accordance with the present invention could be:

$$VCl_x(OR)_{3-x} \quad (1)$$

where x=0-3 and R=a hydrocarbon radical;

$VCl_4$;

$VO(AcAc)_2$, where AcAc=acetyl acetonate which may or may not be alkyl-substituted (e.g.$_1$ to $C_6$ alkyl);

$V(AcAc)_3$;

V(dicarbonyl moiety)3;

$VOCl_x(AcAc)_{3-x}$, where x=1 or 2;

V(dicarbonyl moiety)$_3$Cl; and $VCl_3.nB$, where n=2-3, B=Lewis base capable of making hydrocarbon-soluble complexes with $VCl_3$, such as tetrahydrofuran, 2-methyl-tetrahydrofuran and dimethyl pyridine, and the dicarbonyl moiety is derived from a dicarbonyl compound of the formula:

$$R-\underset{\underset{O}{\|}}{C}-R'-\underset{\underset{O}{\|}}{C}-R$$

In formula (1) above, each R (which can be the same or different) preferably represents a $C_1$ to $C_{10}$ aliphatic, alicyclic or aromatic hydrocarbon radical such as ethyl (Et), phenyl, isopropyl, butyl, propyl, n-butyl, i-butyl, t-butyl, hexyl, cyclohexyl, octyl, naphthyl, etc. R, preferably represents an alkylene divalent radical of 1 to 6 carbons (e.g., $-CH_2-$, $-C_2H_4-$, etc.). Nonlimiting illustrative examples of formula (1) compounds are vanadyl trihalides, alkoxy halides and alkoxides such as $VOCl_3$, $VOCl_2$ (OBu) where Bu=butyl, and $VO(OC_2H_5)_3$. The most preferred vanadium compounds are $VCl_4$, $VOCl_3$, and $VOCl_2(OR)$.

As already noted, the co-catalyst is preferably organo-aluminum compound. In terms of chemical formulas, these compounds could be as follows:

| | |
|---|---|
| $AlR_3$, | $Al(OR)R_2$, |
| $AlR_2Cl$, | $R_2Al-AlR_2$, |
| AlR, RCl, | $AlR_2I$, |
| $Al_2R_3Cl_3$, | and |
| $AlRCl_2$, | |

where R and R, represent hydrocarbon radicals, the same or different, as described above with respect to the vanadium compound formula. The most preferred organo-aluminum compound is an aluminum alkyl sesquichloride such as $Al_2Et_3Cl_3$ or $Al_2(iBu)_3Cl_3$.

In terms of performance, a catalyst system comprised of $VCl_4$ and $Al_2R_3Cl_3$, preferably were R is ethyl, has been shown to be particularly effective. For best catalyst performance, the molar amounts of catalyst components added to the reaction mixture should provide a molar ratio of aluminum/vanadium (Al/V) of at least about 2. The preferred minimum Al/V is about 4. The maximum Al/V is based primarily on the considerations of catalyst expense and the desire to minimize the amount of chain transfer that may be caused by the organo-aluminum compound (as explained in detail below). Since, as is known certain organo-aluminum compound act as chain transfer agents, if too much is present in the reaction mixture the $\overline{M}_w/\overline{M}_n$ of the copolymer may rise above 2. Based on these considerations, the maximum Al/V could be about 25, however, a maximum of about 17 is more preferred. The most preferred maximum is about 15.

With reference again to processes for making copolymer in accordance with the present invention, it is well known that certain combinations of vanadium and aluminum compounds that can comprise the catalyst system can cause branching and gelation during the polymerization for polymers containing high levels of diene. To prevent this from happening Lewis bases such as ammonia, tetrahydrofuran, pyridine, tributylamine, tetrahydrothiophene, etc., can be added to the polymerization system using techniques well known to those skilled in the art.

Chain transfer agents for the Ziegler-catalyzed polymerization of alpha-olefins are well known and are illustrated, by way of example, by hydrogen or diethyl zinc for the production of EPM and EPDM. Such agents are very commonly used to control the molecular weight of EPM and EPDM produced in continuous flow stirred reactors. For the essentially single active species Ziegler catalyst systems used in accordance with the present invention, addition of chain transfer agents to a CFSTR reduces the polymer molecular weight but does not affect the molecular weight distribution. On the other hand, chain transfer reactions during tubular reactor polymerization in accordance with the present invention broaden polymer molecular weight distribution and Inter-CD. Thus the presence of chain transfer agents in the reaction mixture should be minimized or omitted altogether. Although difficult to generalize for all possible reactions, the amount of chain transfer agent used should be limited to those amounts that provide copolymer product in accordance with the desired limits as regards MWD and compositional dispersity. It is believed that the maximum amount of chain transfer agent present in the reaction mixture could be as high as about 0.2 mol/mol of transition metal, e.g., vanadium again provided that the resulting copolymer product is in accordance with the desired limits as regards MWD and compositional dispersity. Even in the absence of added chain transfer agent, chain transfer reactions can occur because propylene and the organo-aluminum cocatalyst can also act as chain transfer agents. In general, among the organo-aluminum compound that in combination with the vanadium compound yield just one active species, the organo-aluminum compound that gives the highest copolymer molecular weight at acceptable catalyst activity should be chosen. Furthermore, if the Al/V ratio has an effect on the molecular weight of copolymer product, that Al/V should be used which gives the highest molecular weight also at acceptable catalyst activity. Chain transfer with propylene can best be limited by avoiding excessively elevated temperature during the polymerization as described below.

Molecular weight distribution and Inter-CD are also broadened by catalyst deactivation during the course of the polymerization which leads to termination of growing chains. It is well known that the vanadium-based Ziegler catalysts used in accordance with the present invention are subject to such deactivation reactions which depend to an extend upon the composition of the catalyst. Although the relationship between active catalyst lifetime and catalyst system composition is not known at present, for any given catalyst, deactivation can be reduced by using the shortest residence time and lowest temperature in the reactor that will produce the desired monomer conversions.

Polymerizations in accordance with the present invention should be conducted in such a manner and under conditions sufficient to initiate propagation of essentially all copolymer chains simultaneously. This can be accomplished by utilizing the process steps and conditions described below.

The catalyst components are preferably premixed, that is, reacted to form active catalyst outside of the reactor, to ensure rapid chain initiation. Aging of the premixed catalyst system, that is, the time spent by the catalyst components (e.g., vanadium compound and organo-aluminum) in each other's presence outside of the reactor, should preferably be kept within limits. If not aged for a sufficient period of time, the components will not have reacted with each other sufficiently to yield an adequate quantity of active catalyst species, with the result of nonsimultaneous chain initiation. Also, it is known that the activity of the catalyst species will decrease with time so that the aging must be kept below a maximum limit. It is believed that the minimum aging period, depending on such factors as concentration of catalyst components, temperature and mixing equipment, could be as low as about 0.1 second. The preferred minimum aging period is about 0.5 second, while the most preferred minimum aging period is about 1 second. While the maximum aging period could be higher, for the preferred vanadium/organo-aluminum catalyst system the preferred maximum is about 200 seconds. A more preferred maximum is about 100 seconds. The most preferred maximum aging period is about 50 seconds. The premixing could be preformed at low temperature such as 40° C. or below. It is preferred that the premixing be performed at 30° C. or below, with 25° C. or below being most preferred.

Preferably, the catalyst components are premixed in the presence of the selected polymerization diluent or solvent under rapid mixing conditions, e.g., at impingement Reynolds Numbers (NRE) of at least 10,000, more preferably at least 50,000, and most preferably at least 100,000. Impingement Reynolds number is defined as $$N_{RE} = \frac{DN\rho}{\mu}$$

where N is fluid flow velocity (cm/sec), D is inside tube diameter (cm), $\rho$ is fluid density (g./cm$^3$) and $\mu$ is fluid viscosity (poise).

The temperature of the reaction mixture should also be kept within certain limits. The temperature at the reactor inlets should be high enough to provide complete, rapid chain initiation at the start of the polymerization reaction. The length of time the reaction mixture spends at high temperature must be short enough to minimize the amount of undesirable chain transfer and catalyst deactivation reactions.

Temperature control of the reaction mixture is complicated somewhat by the fact that the polymerization reaction generates large quantities of heat. This problem is, preferably, taken care of by using prechilled feed to the reaction to absorb the heat of polymerization. With this technique, the reactor is operated adiabatically and the temperature is allowed to increase during the course of polymerization. As an alternative to feed prechill, heat can be removed from the reaction mixture, for example, by a heat exchanger surrounding at least a portion of the reactor or by well-known autorefrigeration techniques in the case of batch reactors or multiple stirred reactors in series.

If adiabatic reactor operation is used, the inlet temperature of the reactor feed could be about from −50° C. to 150° C. It is believed that the outlet temperature of the reaction mixture could be as high as about 200° C. The preferred maximum outlet temperature is about 70° C. The most preferred maximum is about 60° C. In the absence of reactor cooling, such as by a cooling jacket, to remove the heat of polymerization, it has been determined (for a mid-range ethylene content EP copolymer and a solvent with heat capacity similar to hexane) that the temperature of the reaction mixture will increase from reactor inlet to outlet by about 13° C. per weight percent of copolymer in the reaction mixture (weight of copolymer per weight of solvent).

Having the benefit of the above disclosure, it would be well within the skill of the art to determine the operating temperature conditions for making copolymer in accordance with the present invention. For example, assume an adiabatic reactor and an outlet temperature of 35° C. are desired for a reaction mixture containing 5% copolymer. The reaction mixture will increase in temperature by about 13° C. for each weight percent copolymer of 5 wt % × 13° C./wt. % = 65° C. To maintain an outlet temperature of 35° C., it will thus require a feed that has been prechilled to 35° C. − 65° C. = −30° C. In the instance that external cooling is used to absorb the heat of polymerization, the feed inlet temperature could be higher with the other temperature constraints described above otherwise being applicable.

Because of heat removal and reactor temperature limitations, the preferred maximum copolymer concentration at the reactor outlet is 25 wt./100 wt. diluent. The most preferred maximum concentration is 15 wt./100 wt. There is no lower limit to concentration due to reactor operability, but for economic reasons it is preferred to have a copolymer concentration of at least 2 wt/100 wt. Most preferred is a concentration of at least 3 wt/100 wt.

The rate of flow of the reaction mixture through the reactor should be high enough to provide good mixing of the reactants in the radial direction and minimize mixing in the axial direction. Good radial mixing is beneficial not only to both the Intra- and Inter-CD of the copolymer chains but also to minimize radial temperature gradients due to the heat generated by the polymerization reaction. Radial temperature gradients in the case of multiple segment polymers will tend to broaden the molecular weight distribution of the copolymer since the polymerization rate is faster in the high temperature regions resulting from poor heat dissipation. The artisan will recognize that achievement of these objectives is difficult in the case of highly viscous solutions. This problem can be overcome to some extent through the use of radial mixing devices such as static mixers (e.g., those produced by the Kenics Corporation).

It is believed that residence time of the reaction mixture in the mix-free reactor can vary over a wide range. It is believed that the minimum could be as low as about 0.2 second. A preferred minimum is about 0.5 second. The most preferred minimum is about 1 second. It is believed that the maximum could be as high as about 3600 seconds. A preferred maximum is about 40 seconds. The most preferred maximum is about 20 seconds.

Preferably, the fluid flow of the polymerization reaction mass through the tubular reactor will be under turbulent conditions, e.g., at a flow Reynolds Number (NR) of at least 10,000, more preferably at least 50,000, and most preferably at least 100,000 (e.g., 150,000 to 250,000), to provide the desired radial mixing of the fluid in the reactor. Flow Reynolds Number is defined as $$NR = \frac{D'N\rho}{\mu}$$

wherein N' is fluid flow velocity (cm/sec), D, is inside tube diameter of the reactor (cm), $\rho$ is fluid density (g/cm$^3$) and $\mu$ is fluid viscosity (poise).

If desired, catalyst activators for the selected vanadium catalysts can be used as long as they do not cause the criteria for a mix-free reactor to be violated, typically in amounts up to 20 mol %, generally up to 5 mol%, based on the vanadium catalyst, e.g., butyl perchlorocrotonate, benzoyl chloride, and other activators disclosed in Ser. Nos. 504,945 and 50,946, filed May 15, 1987, the disclosures of which are hereby incorporated by reference in their entirety. Other useful catalyst activators include esters of halogenated organic acids, particularly alkyl trichloroacetates, alkyl tribromoacetates, esters of ethylene glycol monoalkyl (particularly monoethyl) ethers with trichloroacetic acid and alkyl perchlorocrotonates, and acyl halides. Specific examples of these compounds include benzoyl chloride, methyl trichloroacetate, ethyl trichloroacetate, methyl tribromoacetate, ethyl tribromoacetate, ethylene glycol monoethyl ether trichloroacetate, ethylene glycol monoethyl ether tribromoacetate, butyl perchlorocrotonate and methyl perchlorocrotonate.

By practicing processes in accordance with the present invention, alpha-olefin copolymers having very narrow MWD can be made by direct polymerization. Although narrow MWD copolymers can be made using other known techniques, such as by fractionation or mechanical degradation, these techniques are considered to be impractical to the extent of being unsuitable for commercial-scale operation. As regards EPM and EPDM made in accordance with the present invention, the products have good shear stability and (with specific intramolecular CD) excellent low temperature properties which make them especially suitable for lube oil applications.

It is preferred that the Intra-CD of the copolymer is such that at least two portions of an individual intramolecularly heterogeneous chain, each portion comprising at least 5 weight percent of said chain, differ in composition from one another by at least 5 weight percent ethylene. The Intra-CD can be such that at least two portions of copolymer chain differ by at least 10 weight percent ethylene. Differences of at least 20 weight percent, as well as, 40 weight percent ethylene are also considered to be in accordance with the present invention.

It is also preferred that the Inter-CD of the copolymer is such that 95 wt. % of the copolymer chains have an ethylene composition that differs from the copolymer average weight percent ethylene composition by 15 wt. % or less. The preferred Inter-CD is about 13% or less, with the most preferred being about 10% or less.

The second additive or component compositions of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the second additive composition, for instance, is soluble or stably dispersible in oil to an extent sufficient to exert its intended effect in the environment in which the oil is employed. Moreover, the additional incorporation of other additives may also permit incorporation of higher levels of a particular first additive composition hereof, if desired.

The lubricating oil compositions of the present invention contain an amount of said second additive or component composition which is effective to improve the viscometric properties, particularly viscosity index of the lubricating oil composition, e.g., a viscosity index improving effective amount. Generally, this effective amount may vary depending upon the particular type of oil. Accordingly, while any effective amount of the second additive composition can be incorporated into the final, e.g., fully formulated, lubricating oil composition, it is contemplated that such effective amount be sufficient to provide said lube oil composition with an amount of the second additive composition of typically from about 0.01 to about 10, preferably from about 0.05 to about 5, and more preferably from about 0.1 to about 3.0 wt. percent, based on the weight of said lubricating composition.

The additive compositions of the present invention can be incorporated into the lubricating oil in any convenient way. Thus, they can be added directly to the oil by dispersing, or dissolving the same in the oil at the desired level of concentration. Such blending can occur at elevated temperatures. Alternatively, the additive compositions may be blended with a base oil to form a concentrate, and the concentrate then blended with lubricating oil base stock to obtain the final composition. Such concentrates will typically contain the first additive composition in amounts of from about 0.5 to about 6, preferably from about 0.5 to about 5 percent by weight, based on the concentrate weight, and the second additive composition in amounts of from about 0.5 to about 20, preferably from about 0.5 to about 12 percent by weight, based on the concentrate weight.

It is to be noted that the amounts of the additive compositions of this invention present in the fully formulated oil compositions or concentrates are on an active ingredient basis (a.i.).

The lubricating oil base stock for the additive compositions of the present invention typically is adapted to perform a selected function by the incorporation of other additives therein to form lubricating oil compositions designated as formulations.

Representative other additives typically present in such formulations include corrosion inhibitors, oxidation inhibitors, friction modifiers, dispersants, antifoaming agents, anti-wear agents, detergents, rust inhibitors and the like.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 wt. percent of a sulfide of phosphorus for ½ to 15 hours, at a temperature in the range of 150° to 600°F. Neutralization of the phosphosulfurized hydrocarbon may be effected in the manner taught in U.S. Pat. No. 1,969,324.

Oxidation inhibitors reduce the tendency of mineral oils to deteriorate in service which deterioration can be evidenced by the products of oxidation such as sludge and varnish-like deposits on the metal surfaces, and by viscosity growth. Such oxidation inhibitors include alkaline earth metal salts of alkyl phenolthioesters having preferably $C_5$ to $C_{12}$ alkyl side chains, e.g., calcium nonylphenol sulfide, barium t-octylphenyl sulfide, dioctylphenylamine, phenylalpha-naphthylamine, phosphosulfurized or sulfurized hydrocarbons, etc.

Friction modifiers serve to impart the proper friction characteristics to lubricating oil compositions such as automatic transmission fluids.

Representative examples of suitable friction modifiers are found in U.S. Pat. No. 3,933,659 which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxyalkylene hydrocarbyl succinimide, S-carboxyalkylene hydrocarbyl succinamic acid and mixtures discloses thereof; U.S. Pat. No. 3,879,306 which N-(hydroxyalkyl)alkenyl-succinamic acids or succinimides; U.S. Pat. No. 3,932,290 which discloses reaction products of di- (lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobisalkanols such as described in U.S. Pat. No. 4,344,853.

Dispersants maintain oil insolubles, resulting from oxidation during use, in suspension in the fluid thus preventing sludge flocculation and precipitation or deposition on metal parts. Suitable dispersants include high molecular weight alkyl succinates, the reaction product of oil-soluble polyisobutylene succinic anhydride with ethylene amines such as tetraethylene pentamine and borated salts thereof.

Foam control can be provided by an antifoamant of the polysiloxane type, e.g., silicone oil and polydimethyl siloxane.

Anti-wear agents, as their name implies, reduce wear of metal parts. Representatives of conventional antiwear agents are zinc dialkyldithiophosphate and zinc diaryldithiosphate.

Detergents and metal rust inhibitors include the metal salts of sulphonic acids, alkyl phenols, sulfurized alkyl phenols, alkyl salicylates, naphthenates and other oil soluble mono- and di-carboxylic acids. Highly basic (viz, overbased) metal salts, such as highly basic alkaline earth metal sulfonates (especially Ca and Mg salts) are frequently used as detergents. Representative examples of such materials, and their methods of preparation, are found in co-pending Ser. No. 754,001, filed Jul. 11, 1985, the disclosure of which is hereby incorporated by reference.

Some of these numerous additives can provide a multiplicity of effects, e.g., a dispersant-oxidation inhibitor. This approach is well known and need not be further elaborated herein.

Compositions when containing these conventional additives are typically blended into the base oil in amounts which are effective to provide their normal attendant function. Representative effective amounts of such additives are illustrated as follows:

| Additive | % Active Ingredient By Volume | Weight |
|---|---|---|
| Corrosion Inhibitor | 0.01-1 | 0.01-1.5 |
| Oxidation Inhibitor | 0.01-1 | 0.01-1.5 |
| Dispersant | 0.1-7 | 0.1-8 |
| Anti-Foaming Agents | 0.001-0.1 | 0.001-0.15 |
| Anti-Wear Agents | 0.001-1 | 0.001-1.5 |
| Friction Modifiers | 0.01-1 | 0.01-1.5 |
| Detergents/Rust Inhibitors | 0.01-2.5 | 0.01-3 |
| Mineral Oil Base | Balance | Balance |

When other additives are employed, it may be desirable, although not necessary, to prepare additive concentrates comprising concentrated solutions or dispersions of the dual additive composition (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the dual additive composition and optional additional additives in proper amounts to provide the desired concentration in the final formulation when the additive-package is combined with a predetermined amount of base lubricant. Thus, the additive composition of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

The final formulations may employ typically about 10 wt. % of the additive-package with the remainder being base oil.

All of said weight and volume percents expressed herein are based on active ingredient (a.i.) content of the additive, and/or upon the total weight of any additive-package, or formulation which will be the sum of the a.i. weight of each additive plus the weight of total oil or diluent.

Neither the oleaginous compositions nor the additive concentrates of the instant invention contain, i.e., are free of, the first component additive described in application Ser. No. 53,698, filed May 22, 1987. These first component compositions of U.S. Ser. No. 53,698 are comprised of low molecular weight polymers and interpolymers (e.g., copolymers of unsaturated mono- or dicarboxy esters having the formula:

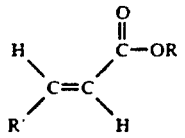

(1)

in which R′ is either hydrogen or a COOR radical, and R is a $C_{14}$ alkyl group. The interpolymers are comprised of the dicarboxy esters of formula (1) interpolymerized with vinyl esters such as vinyl acetate, alpha-olefins, or stryene.

It is to be understood that, in contrast to U.S. Ser. No. 53,698, the instant compositions do not contain a polymer or interpolymer of a dicarboxy ester of formula (1) wherein the R groups are derived solely from a $C_{14}$ alcohol. The instant polymers or copolymers are derived from carboxy esters wherein the esterifying alcohol reactant comprises the mixture of alcohols, including a $C_{14}$ alcohol as one of the alcohols of said mixture, as described hereinafore, and not from carboxy esters wherein the sole esterifying alcohol reactant is only a $C_{14}$ alcohol.

The following examples are given as specific illustrations of the claimed invention. It should be understood, however, that the invention is not limited to the specific details set forth in the examples. All parts and percentages in the examples, as well as in the remainder of the specification, are by weight unless otherwise specified.

This Example illustrates the preparation of a V.I. improver second additive composition of the instant invention.

EXAMPLE A

An ethylene-propylene copolymer having an ethylene content of about 56 wt. %, an $\overline{M}_w$ of 180,000, a $\overline{M}_z/\overline{M}_w$ of 1.15, and a $\overline{M}_w/\overline{M}_n$ of 1.34 is prepared in a tubular reactor under the following conditions:

| | |
|---|---|
| Reactor Inlet Temp. (°C.) | −1.3 |
| Reactor Outlet Temp. (°C.) | 53 |
| Sidestream Feed Temp. (°C.) | −10 |
| Catalyst Premix Temp. (°C.) | 16.6 |
| Catalyst Premix Time (°C.) | 4.85 |
| Reactor Residence Time (Sec.) at Sidestream 1/2/3/4/5/6 | .24/.48/1.57/1.72/1.87/2.04 |
| Inlet Feed Rates (lb./hr.) | |
| Hexane | 169,000 |
| Ethylene | 830 |
| Propylene | 11,900 |
| $VCl_4$ | 44.0 |
| $Al_2(C_2H_5)_3Cl_3$ | 1,135 |
| Sweep Hexane | 10,400 |
| Sidestream Feed Rates (lb./hr.) | |
| Hexane | 85,900 |
| Ethylene | 8,300 |
| Propylene | 13,200 |
| Total Hexane (lb./hr.) | 254,900 |
| Sidestream Feed Splits (wt. %) Sidestream 1/2/3/4/5/6 | 6.7/6.3/30.4/18.8/16.7/21.1 |

The following Comparative Examples illustrate lube oil formulations falling outside the scope of the instant invention and are presented for comparative purposes only.

The lubricating base oils of Comparative Examples 1-4 contained various amounts (as specified in these Comparative Examples) of conventional lube oil flow improver, designated LOFI B, comprising dialkyl fumarate/vinyl acetate interpolymer. The fumarate ester monomers were derived from (i.e., the fumaric acid monomers were esterified with) a mixture of alcohols having the approximate respective carbon distributions shown in TABLE I.

TABLE I

CARBON DISTRIBUTION OF ALCOHOLS USED TO ESTERIFY THE FUMARATE

| Carbon No. | wt. % |
|---|---|
| 10 | 2.5 max |
| 12 | 56 |
| 14 | 21 |
| 16 | 10 |
| 18 | 11 |

The fumarate:vinyl acetate mole ratio employed in the synthesis of these dialkyl fumarate/vinyl acetate interpolymers was 1:0.8.

COMPARATIVE EXAMPLE 1

A fully formuated 15W-40 lubricating base oil was prepared containing mineral oil base stock, 0.5 wt. % (a.i.) of V.I. improver of Example A, 0.08 weight % (a.i.) LOFI B, and a conventional detergent/inhibitor package containing ashless dispersant, anti-oxidant and anti-wear additive, and overbased sulfonate.

COMPARATIVE EXAMPLE 2

A fully formulated 10W-40 lubricating base oil was prepared containing mineral oil base stock, 0.7 weight % (a.i.) of V.I. improver of Example A, 0.1 weight % (a.i.) LOFI B, and a conventional detergent/inhibitor package containing ashless dispersant, anti-oxidant and anti-wear additive, and overbased sulfonate.

COMPARATIVE EXAMPLE 3

Comparative Example 2 was repeated except that no lubricating oil flow improver (LOFI) was present.

COMPARATIVE EXAMPLE 4

A fully formulated 10W-30 lubricating base oil was prepared containing mineral oil base stock, 0.3 weight % (a.i.) of V.I. improver of Example A, 0.05 weight % (a.i.) LOFI B, and a conventional detergent/inhibitor package containing ashless dispersant, anti-oxidant and anti-wear additive, and overbased sulfonate.

COMPARATIVE EXAMPLE 5

Comparative Example 4 was repeated except that no lubricating oil flow improver (LOFI) was present.

COMPARATIVE EXAMPLE 6

A fully formulated 5W-30 lubricating base oil was prepared containing mineral oil base stock, 0.5 weight % (a.i.) of V.I. improver of Example A, 0.08 weight % (a.i.) LOFI B, and a conventional detergent/inhibitor package containing ashless dispersant, anti-oxidant and anti-wear additive, and overbased sulfonate.

COMPARATIVE EXAMPLE 7

Comparative Example 6 was repeated except that no lubricating oil flow improver (LOFI) was present.

The following Examples illustrate lube oil formulations of the instant invention.

The lubricating base oils of Examples 5-8 contained various amounts (as specified in said Examples) of a lube oil flow improver of the instant invention, designated LOFI A, comprising dialkyl fumarate/vinyl acetate. For LOFI A the dialkyl fumarate monomers were derived from (i.e., the fumaric acid monomers were esterified with) an alcohol mixture obtained by mixing two different mixtures of alcohols. The first mixture of alcohols, herein referred to as alcohol mixture 1, had the approximate respective carbon distributions shown in TABLE I. The second mixture of alcohols, herein referred to as mixture 2, had the approximate respective carbon distributions shown at TABLE II.

TABLE II

| CARBON DISTRIBUTION OF ALCOHOL MIXTURE 2 | |
|---|---|
| Carbon No. | wt. % |
| $C_{13}$ | 5.0 max |
| $C_{14}$ | 58 ±12 |
| $C_{15}$ | 42 ±12 |
| $C_{16}$ | 1.0 max |

Alcohol mixtures 1 and 2 were mixed, in a ratio by weight, of part of alcohol mixture to 2 parts of alcohol mixture 2. The fumarate: vinyl acetate mole ratio employed in the synthesis of LOFI A was 1:0.8.

EXAMPLE 8

Comparative Example 1 was repeated except that the LOFI B of Comparative Example 1 was replaced with 0.08 weight % (a.i.) of LOFI A. With the exception of the LOFI, the types and amounts of other additives were the same as in Comparative Example 1.

EXAMPLE 9

Comparative Example 2 was repeated except that the LOFI B of Comparative Example 2 was replaced with 0.1 weight % (a.i.) of LOFI A. With the exception of the LOFI, the types and amounts of other additives were the same as in Comparative Example 2.

EXAMPLE 10

Comparative Example 4 was repeated except that the LOFI B of Comparative Example 4 was replaced with 0.05 weight % (a.i.) of LOFI A. With the exception of the LOFI, the types and amounts of other additives were the same as in Comparative Example 4.

EXAMPLE 11

Comparative Example 6 was repeated except that the LOFI B of Comparative Example 6 was replaced with 0.08 weight % (a.i.) of LOFI A. With the exception of the LOFI, the types and amounts of other additives were the same as in Comparative Example 6.

The flow properties of Comparative Examples 1-7 and of Examples 8-11 were tested by the Mini Rotory Viscometer (MRV) procedure, and the results are summarized in TABLE III. The analysis of the flow properties was conducted by testing the lubricating oil formulations in a Mini Rotory Viscometer after subjecting each sample to a temperature profile controlled in accordance with ASTM D4684 over about a 40 to 44 hour cooling cycle. More specifically, this test is used by the SAE (J300 Specification-JUN87) for determining the low temperature pumpability of an engine oil. In the test procedure itself, the temperature is gradually lowered to −20° C. for 15W-40, −25° C. for 10W-30 and 10W-40, and −30° C. for 5W-30, and then at that temperature the yield stress (YS) is measured in pascals, and the apparent viscosity (VIS) is measured in pascal seconds. The latter is required because this is a two-phase system, so that a true viscosity measurement cannot be made. Thus, in accordance with SAE requirements for 15W-40 oils, the target values of less than 35 pascals (YS) and not greater than 300 pascals seconds (VIS) are considered acceptable in order to provide a pumpable composition at −20° C., i.e., to maintain fluidity. For purposes of the instant application, a sample is considered to "fail" if either the YS is greater than 35 pascals or the viscosity is greater than 300 pascal seconds.

TABLE III

| Example or Comparative Example No. | LOFI A (wt. %) | LOFI B (wt. %) | V.I. Improver (wt. %) | ASTM D4684 Temp. °C. | MRV TEST RESULTS YS (Pascals) | MRV TEST RESULTS VIS (Pascal Seconds) |
|---|---|---|---|---|---|---|
| Comp. Ex. 1 | 0 | 0.08 | 0.5 | −20 | <70 | 238 |
| Comp Ex. 2 | 0 | 0.1 | 0.7 | −25 | <105 | 800 |
| Comp. Ex. 3 | 0 | 0 | 0.7 | −25 | >175 | 3580 |
| Comp. Ex. 4 | 0 | 0.05 | 0.3 | −25 | <70 | 344 |
| Comp. Ex. 5 | 0 | 0 | 0.3 | −25 | <140 | 947 |
| Comp. Ex. 6 | 0 | 0.08 | 0.5 | −30 | <70 | 299 |
| Comp. Ex. 7 | 0 | 0 | 0.5 | −30 | >175 | 2510 |
| Example 8 | 0.08 | 0 | 0.5 | −20 | <35 | 106 |
| Example 9 | 0.1 | 0 | 0.7 | −25 | <35 | 174 |
| Example 10 | 0.05 | 0 | 0.3 | −25 | <35 | 130 |
| Example 11 | 0.08 | 0 | 0.5 | −30 | <35 | 157 |
| | Targets | | | | <35 | <300 |

As illustrated by the data in TABLE III, the combination of the first and second additive compositions of the present invention provide lube oil formulation (Examples 8-11) which meet the targets for SAE 15W-40, 10W-30, 10W-40, and 5W-30 oils. In contrast, using a lubricating oil flow improver falling outside the scope of the instant invention (Comparative Examples 1, 2, 4 and 6), or not using any lubricating oil flow improver (Comparative Examples 3, 5 and 7) results in oil formulations (Comparative Examples 1-7) which fail to meet the SAE requirements.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spririt and scope of the present invention as defined by the appended claims.

What is claimed is:

1. A lubricating oil composition comprising lubricating oil and (i) an amount effective to improve the low temperature flow properties of said lubricating oil composition of additive consisting essentially of at least one low molecular weight non-ethylene containing polymer of interpolymer containing pendent ester groups comprising repeating methylene units derived from mixture of aliphatic alcohols, said mixture containing at least about 35 weight percent $C_{14}$ alcohol; and (ii) an amount effective to improve the viscosity index of said lubricating oil composition of additive comprising copolymer of ethylene and at least one other alpha-olefin monomer, said copolymer comprising intramolecularly heterogeneous copolymer chains containing at least one crystallizable segment of methylene units and at least on e low crystallinity ethylene-alphaolefin copolymer segment, wherein said at least one crystallizable segment comprises at least about 10 weight percent of said copolymer chain and contains an average ethylene content of at least about 57 weight percent, wherein said low crystallinity segment contains an average of not greater than about 53 weight percent ethylene, and wherein said copolymer has a molecular weight distribution wherein at least the ratio of $\overline{M}w/\overline{M}n$ is less than 2 or the ratio of $\overline{M}z/\overline{M}w$ is less than 1.8, and wherein at least two portions of an individual intramolecularly heterogeneous chain, each portion comprising at least 5 weight percent of said chain, differ in composition from one another by at least 7 weight percent ethylene.

2. The lubricating oil composition of claim 1 wherein (i) is at least one member selected from the group consisting of (a) polyacrylates, (b) poly-2-alkylacrylates, (c) polymers comprised of monomers comprising $C_4$ to $C_{10}$ monoethylenically unsaturated dicarboxylic acid or anhydride esterified with said mixture of alcohols, and (d) interpolymers comprised of monomers comprising $C_4$ to $C_{10}$ monoethylenically unsaturated dicarboxylic acid or anhydride esterified with said alcohol mixture and comonomer selected from the group consisting of vinyl esters, alpha-olefins, and styrenes.

3. The lubricating oil composition of claim 2 wherein said mixture of alcohols is comprised of mixture of $C_1$ to about $C_{20}$ alcohols.

4. The lubricating oil composition of claim 3 wherein said mixture of alcohols is comprised of mixture of about $C_6$ to about $C_{20}$ alcohols.

5. The lubricating oil composition of claim 4 wherein said mixture of alcohols is comprised of mixture of about $C_8$ to about $C_{18}$ alcohols.

6. The lubricating oil composition of claim 5 wherein said mixture of alcohols is comprised of mixture of about $C_{10}$ to about $C_{18}$ alcohols.

7. The lubricating oil composition of claim 3 wherein (i) is (c).

8. The lubricating oil composition of claim 7 wherein said $C_4$ to $C_{10}$ monoethylenically unsaturated dicarboxylic acid or anhydride is fumaric acid.

9. The lubricating oil composition of claim 7 wherein said $C_4$ to $C_{10}$ monoethylenically unsaturated dicarboxylic acid or anhydride is selected from the group consisting of maleic acid, maleic anhydride, and mixtures thereof.

10. The lubricating oil composition of claim 9 wherein said $C_4$ to $C_{10}$ monoethylenically unsaturated dicarboxylic acid or anhydride is maleic anhydride.

11. The lubricating oil composition of claim 3 wherein (i) is (d).

12. The lubricating oil composition of claim 4 wherein said comonomer is vinyl ester represented by the formula

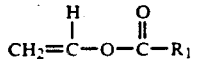

wherein $R_1$ is an alkyl group containing from 1 to 18 carbon atoms.

13. The lubricating oil composition of claim 12 wherein said $C_4$ to $C_{10}$ monoethylenically unsaturated dicarboxylic acid or anhydride is fumaric acid.

14. The lubricating oil composition of claim 13 wherein said vinyl ester is vinyl acetate.

15. The lubricating oil composition of claim 14 wherein said alcohol mixture comprises a mixture of from about $C_8$ to about $C_{18}$ aliphatic alcohols, and contains at least about 35 weight percent of $C_{14}$ aliphatic alcohol.

16. The lubricating oil composition of claim 1 wherein (i) is present in an amount comprising between about 0.001 and about 1.5 wt. % thereof.

17. The lubricating oil composition of claim 16 wherein (i) is present in an amount comprising between about 0.005 to about 1.0 wt. % thereof.

18. The lubricating oil composition of claim 17 wherein(i) is present in an amount comprising between about 0.01 and about 0.5 wt. % thereof.

19. The lubricating oil composition of claim 1 wherein in (ii) said copolymer has an intermolecular compositional dispersity such that 95 weight % of said copolymer chains have a composition 15 weight % or less different from said average ethylene composition.

20. The lubricating oil composition of claim 19 wherein said intermolecular compositional dispersity of said copolymer of (ii) is such that 95 weight % of said copolymer chains have a composition 10 wt. % or less different from said average ethylene composition.

21. The lubricating oil composition of claim 1 wherein in (ii) said low crystallinity segment comprises from about 20 to 53 wt. % ethylene.

22. The lubricating oil composition of claim 1 wherein in (ii) said crystallizable segment comprises at least about 57 wt. % ethylene.

23. The lubricating oil composition of claim 22 wherein said copolymer of (ii) has by a weight average molecular weight of from about 10,000 to about 750,000.

24. The lubricating oil composition of claim 1 wherein said copolymer of (ii) has a MWD wherein at least the ratio $\overline{M}w/\overline{M}n$ is less than about 1.5 or the ratio $\overline{M}z/\overline{M}w$ is less than about 1.5 and wherein said at least two portions of an individual chain differ in composition from one another by at least 10 weight percent ethylene.

25. The lubricating oil composition of claim 1 wherein said copolymer of (II) has a MWD wherein $\overline{M}w/\overline{M}w$ and $\overline{M}z/\overline{M}w$ are both less than about 1.5.

26. The lubricating oil composition of claim 1 wherein said copolymer of (ii) has a MWD wherein at least the ratio $\overline{M}w/\overline{M}n$ is less than about 1.25 or the ratio $\overline{M}z/\overline{M}w$ is less than about 1.2.

27. The lubricating oil composition of claim 1 wherein said copolymer of (ii) has MWD wherein the ratio $\overline{M}w/\overline{M}n$ is less than about 1.25 and the ratio $\overline{M}z/\overline{M}w$ is less than about 1.2.

28. The lubricating oil composition of claim 24 or 25 wherein said intermolecular compositional dispersity of said copolymer of (ii) is such that 95 wt. % of said copolymer chains have a composition 13 weight % of less different from said average ethylene composition.

29. The lubricating oil composition of claim 26 or 27 wherein said intermolecular compositional dispersity of said copolymer of (ii) is such that 95 wt. % of said copolymer chains have a composition 10 wt. % or less different from said average ethylene composition.

30. The lubricating oil composition of claim 1 wherein said low crystallinity segment of (ii) comprises from about 30 to about 53 wt. % ethylene.

31. The lubricating oil composition of claim 30 wherein said crystallizable segment of (ii) comprises at least about 60 wt. % ethylene.

32. The lubricating oil composition of claim 1 wherein said copolymer of (ii) has a total maximum ethylene content of about 90% on a weight basis, and wherein said at least two portions of an individual chain differ in composition from one another by at least 40 weight percent ethylene.

33. The lubricating oil composition of claim 32 wherein said copolymer of (ii) has a total minimum ethylene content of about 20% on a weight basis.

34. The lubricating oil composition of claim 1 wherein in (ii) said copolymer's chain segment sequences can be represented by at least one of the structures:

$$M-T \quad (I)$$

$$T^1-(M-T^2)_x \quad (II)$$

$$T^1-(M^1-T^2)_y-M^2 \quad (III)$$

wherein x and y are each integers of 1 to 3, M comprises said crystallizable segment, T comprises said low crystallinity segment, $M^1$ and $M^2$ are the same or different and each comprises an M segment, and $T^1$ and $T^2$ are the same or different and each comprises a T segment.

35. The lubricating oil composition of claim 34 wherein in (ii) said copolymer's chain segment sequences are represented by structure I.

36. The lubricating oil composition of claim 34 wherein in (ii) said copolymer's chain segment sequences are represented by structure II.

37. The lubricating oil composition of claim 36 wherein x is one.

38. The lubricating oil composition of claim 37 wherein in (ii) said $T^1$ and $T^2$ segments are of substantially the same weight-average molecular weight.

39. The lubricating oil composition of claim 38 wherein in (ii) the sum of the weight average molecular weights of said $T^1$ and $T^2$ segments is substantially equal to the weight-average molecular weight of said M segment.

40. The lubricating oil composition of claim 39 wherein said copolymer of (ii) has a MWD wherein at least the ratio $\overline{M}w/\overline{M}n$ is less than about 1.5 or the ratio $\overline{M}z/\overline{M}w$ is less than about 1.5.

41. The lubricating oil composition of claim 37 wherein said copolymer of (ii) has a MWD wherein at least the ratio $\overline{M}w/\overline{M}n$ is less than about 1.5 or the ratio $\overline{M}z/\overline{M}w$ is less than about 1.5, and wherein said at least two portions of an individual chain differ in composition from one another by at least 20 weight percent ethylene.

42. The lubricating oil composition of claim 37 wherein said copolymer of (ii) has a MWD wherein at least the ratio $\overline{M}w/\overline{M}n$ is less that about 1.25 or the ratio $\overline{M}z/\overline{M}w$ is less than about 1.2.

43. The lubricating oil composition of claim 37 wherein said copolymer of (ii) has a MWD wherein $\overline{M}w/\overline{M}n$ is less than about 1.25 and $\overline{M}z/\overline{M}w$ is less than about 1.2.

44. The lubricating oil composition of claim 37 in said copolymer of (ii) wherein the intermolecular compositional dispersity of said copolymer is such that 95 weight percent of said copolymer chains have a composition 13 weight % or less different from said average ethylene composition.

45. The lubricating oil composition of claim 44 wherein in said copolymer of (ii) said intermolecular compositional dispersity of said copolymer is such that 95 weight % of said copolymer chains have a composition 10 wt % or less different from said average ethylene composition.

46. The lubricating oil composition of claim 1 wherein said copolymer of (ii) has a total ethylene content of greater than about 35% on a weight basis.

47. The lubricating oil composition of claim 1 wherein said copolymer of (ii) further comprises a diene.

48. The lubricating oil composition of claim 37 wherein said copolymer of (ii) further comprises a diene.

49. The lubricating oil composition of claim 48 wherein in said copolymer of (ii) the total ethylene content is from about 35 to about 75% on a weight basis.

50. The lubricating oil composition of claim 47 wherein said copolymer of (ii) is comprised of ethylene, propylene and 5-ethylidene-2-norbornene.

51. The lubricating oil composition of claim 48 wherein said copolymer of (ii) is comprised of ethylene, propylene and 5-ethylidene-2-norbornene.

52. The lubricating oil composition of claim 1 wherein (ii) is present in an amount comprising from about 0.05 to about 5 weight percent thereof.

53. The lubricating oil composition of claim 52 wherein (ii) is present in an amount comprising from about 0.1 to about 2.5 weight percent thereof.

54. A lubricating oil concentrate composition comprising lubricating oil and:

(i) an amount effective to improve the low temperature flow properties of lubricating oil compositions derived from said concentrate of additive consisting essentially of at least one low molecular weight non-ethylene containing polymer or interpolymer containing pendent ester groups comprising repeating methylene units derived from mixture of aliphatic alcohols, said mixture containing at least about 35 weight percent $C_{14}$ alcohol; and (ii) an amount effective to improve the viscosity index of lubricating oil compositions derived from said concentrate of additive comprising copolymer of ethylene and at least one other alpha-olefin monomer, said copolymer comprising intramolecularly heterogeneous copolymer chains containing at least one crystallizable segment of methylene units and at least one low crystallinity ethylene-alphaolefin copolymer segment, wherein said at least one crystallizable segment comprises at least about 10 weight percent of said copolymer chain and contains an average ethylene content of at least about 57 weight percent, wherein said low crystallinity segment contains an average of not greater than about 53 weight percent ethylene, and wherein said copolymer has a molecular weight distribution wherein at least the ratio of $\overline{M}w/\overline{M}n$ is less than 2 or the ratio $\overline{M}z/\overline{M}w$ is less than 1.8, and wherein at least two portions of an individual intramolecularly heterogeneous chain, each portion comprising at least 5 weight percent of said chain, differ in composition from one another by at least 7 weight percent ethylene.

55. The lubricating oil concentrate composition of claim 54 wherein (i) is at least one member selected from the group consisting of (a) polyacrylates, (b) poly-2-alkylacrylates, (c) polymers comprised of monomers comprising $C_4$ to $C_{10}$ monoethylenically unsaturated dicarboxylic acid or anhydride esterified with said mixture of alcohols and (d) interpolymers comprised of monomers comprising $C_4$ to $C_{10}$ monoethylenically unsaturated dicarboxylic acid or anhydride esterified with said alcohol mixture and comonomer selected from the group consisting of vinyl esters, alpha-olefins, and styrenes.

56. The lubricating oil concentrate composition of claim 55 wherein said mixture of alcohols is comprised of mixture of $C_1$ to about $C_{20}$ alcohols

57. The lubricating oil concentrate composition of claim 56 wherein said mixture of alcohols is comprised of mixture of about $C_6$ to $C_{20}$ alcohols

58. The lubricating oil concentrate composition of claim 57 wherein said mixture of alcohols is comprised of mixture of about $C_8$ to about $C_{18}$ alcohols.

59. The lubricating oil concentrate composition of claim 58 wherein said mixture of alcohols is comprised of mixture of about $C_{10}$ to about $C_{18}$ alcohols.

60. The lubricating oil concentrate composition of claim 56 wherein (i) is (c).

61. The lubricating oil concentrate composition of claim 60 wherein said $C_4$ to $C_{10}$ monoethylenically unsaturated dicarboxylic acid or anhydride is fumaric acid.

62. The lubricating oil concentrate composition of claim 60 wherein said $C_4$ to $C_{10}$ monoethylenically unsaturated dicarboxylic acid or anhydride is selected from the group consisting of maleic acid, maleic anhydride, and mixtures thereof.

63. The lubricating oil concentrate composition of claim 62 wherein said $C_4$ to $C_{10}$ monoethylenically unsaturated dicarboxylic acid or anhydride is maleic anhydride.

64. The lubricating oil concentrate composition of claim 56 wherein (i) is (d).

65. The lubricating oil concentrate composition of claim 64 wherein said comonomer is vinyl ester represented by the formula

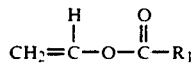

wherein $R_1$ is an alkyl group containing from 1 to 18 carbon atoms.

66. The lubricating oil concentrate composition of claim 65 wherein said $C_4$ to $C_{10}$ monoethylenically unsaturated dicarboxylic acid or anhydride is fumaric acid.

67. The lubricating oil concentrate composition of claim 66 wherein said vinyl ester is vinyl acetate.

68. The lubricating oil concentrate composition of claim 67 wherein said alcohol mixture contains at least about 27 weight percent $C_{14}$ alcohol.

69. The lubricating oil concentrate composition of claim 68 wherein said alcohol mixture contains at least about 30 weight percent $C_{14}$ alcohol.

70. The lubricating oil concentrate composition of claim 54 wherein (i) is present in an amount comprising between about 0.5 and about 6 wt. % thereof.

71. The lubricating oil concentrate composition of claim 70 wherein (i) is present in an amount comprising between about 0.5 and about 5 wt. % thereof.

72. The lubricating oil concentrate composition of claim 54 wherein in (ii) said copolymer has an intermolecular compositional dispersity such that 95 weight % of said copolymer chains have a composition 15 weight % or less different from said average ethylene composition.

73. The lubricating oil concentrate composition of claim 72 wherein said intermolecular compositional dispersity of said copolymer of (ii) is such that 95 weight % of said copolymer chains have a composition 10 wt. % of less different from said average ethylene composition.

74. The lubricating oil concentrate composition of claim 54 wherein in (ii) said low crystallinity segment comprises from about 20 to 53 wt. % ethylene.

75. The lubricating oil concentrate composition of claim 54 wherein (ii) said crystallizable segment comprises at least about 57 wt. % ethylene.

76. The lubricating oil concentrate composition of claim 75 wherein said copolymer of (ii) is characterized by a weight average molecular weight of from about 2,000 to about 1,000,000.

77. The lubricating oil concentrate composition of claim 54 wherein said copolymer of (ii) has a MWD wherein at least the ratio $\overline{M}w/\overline{M}n$ is less than about 1.5 or the ratio $\overline{M}z/\overline{M}w$ is less than about 1.5 and wherein said at least two portions of an individual chain differ in composition from one another by at least 10 weight percent ethylene.

78. The lubricating oil concentrate composition of claim 54 wherein said copolymer of (ii) has a MWD wherein the $\overline{M}w/\overline{M}n$ and $\overline{M}z/\overline{M}w$ are both less than about 1.5.

79. The lubricating oil concentrate composition of claim 54 wherein said copolymer of (ii) has a MWD wherein at least one of $\overline{M}w/\overline{M}n$ or $\overline{M}z/\overline{M}w$ is less than about 1.25.

80. The lubricating oil concentrate composition of claim 54 wherein said copolymer of (ii) has a MWD wherein $\overline{M}w/\overline{M}n$ is less than about 1.25 and $\overline{M}z/\overline{M}w$ is less than about 1.2.

81. The lubricating oil concentrate composition of claim 54 wherein said intermolecular compositional dispersity of said copolymer of (ii) is such that 95 wt. % of said copolymer chains have a composition 13 weight % of less different from said average ethylene composition.

82. The lubricating oil concentrate composition of claim 79 wherein said intermolecular compositional dispersity of said copolymer of (ii) is such that 95 wt. % of said copolymer chains have a composition 10 wt. % or less different from said average ethylene composition.

83. The lubricating oil concentrate composition of claim 54 wherein said low crystallinity segment of (ii) comprises from about 30 to about 53 wt. % ethylene.

84. The lubricating oil concentrate composition of claim 54 wherein said crystallizable segment of (ii) comprises at least about 60 wt. % ethylene.

85. The lubricating oil concentrate composition of claim 54 wherein said copolymer of (ii) has a total maximum ethylene content of about 90% on a weight basis, and wherein said at least two portions of an individual chain differ in composition from one another by at least 40 weight percent ethylene.

86. The lubricating oil concentrate composition of claim 85 wherein said copolymer of (ii) has a total minimum ethylene content of about 20% on a weight basis.

87. The lubricating oil concentrate composition of claim 54 wherein in (ii) said copolymer's chain segment sequences can be represented by at least one of the structures:

$$M-T \quad (I)$$

$$T1-(M-T2)x \quad (II)$$

$$T1-(M1-T2)y-M2 \quad (III)$$

wherein x and y are each integers of 1 to 3, M comprises said crystallizable segment, T comprises said low crystallinity segment M1 and M2 are the same or different and each comprises an M segment, and T1 and T2 are the same or different and each comprises a T segment.

88. The lubricating oil concentrate composition of claim 87 wherein in (ii) said copolymer's chain segment sequences are represented by structure I.

89. The lubricating oil concentrate composition of claim 87 wherein in (ii) said copolymer's chain segment sequences are represented by structure II.

90. The lubricating oil concentrate composition of claim 89 wherein x is one.

91. The lubricating oil concentrate composition of claim 90 wherein in (ii) said $T^1$ and $T^2$ segments are of substantially the same weight-average molecular weight.

92. The lubricating oil concentrate composition of claim 91 wherein in (ii) the sum of the weight average molecular weights of said $T^1$ and $T^2$ segments is substantially equal to the weight-average molecular weight of said M segment.

93. The lubricating oil concentrate composition of claim 92 wherein said copolymer of (ii) has a MWD wherein at least one of the ratios $\overline{M}w/\overline{M}n$ or $\overline{M}z/\overline{M}w$ is less than about 1.5.

94. The lubricating oil concentrate composition of claim 90 wherein said copolymer of (ii) has a MWD wherein at lest one of the ratios $\overline{M}w/\overline{M}n$ or $\overline{M}z/\overline{M}w$ is less than about 1.5, and wherein said at least two portions of an individual chain differ in composition from one another by at least 20 weight percent ethylene.

95. The lubricating oil concentrate composition of claim 90 wherein said copolymer of (ii) has a MWD wherein at least the ratio of $\overline{M}w/\overline{M}n$ is less than about 1.25 or the ratio $\overline{M}z/\overline{M}w$ is less than about 1.2.

96. The lubricating oil concentrate composition of claim 90 wherein said copolymer of (ii) has a MWD wherein $\overline{M}w/\overline{M}n$ is less than about 1.25 and $\overline{M}z/\overline{M}w$ is less than about 1.2.

97. The lubricating oil concentrate composition of claim 90 in said copolymer of (ii) wherein the intermolecular compositional dispersity of said copolymer is such that 95 weight percent of said copolymer chains have a composition 13 weight % or less different from said average ethylene composition.

98. The lubricating oil concentrate composition of claim 97 wherein in said copolymer of (ii) said intermolecular compositional dispersity of said copolymer is such that 95 weight % of said copolymer chains have a composition 10 wt % or less different from said average ethylene composition.

99. The lubricating oil concentrate composition of claim 54 wherein said copolymer of (ii) has a total ethylene content of greater than about 35% on a weight basis.

100. The lubricating oil concentrate composition of claim 54 wherein said copolymer of (ii) further comprises a diene.

101. The lubricating oil concentrate composition of claim 90 wherein said copolymer of (ii) further comprises a diene.

102. The lubricating oil concentrate composition of claim 101 wherein in said copolymer of (ii) the total ethylene content is from about 35 to about 75% on a weight basis.

103. The lubricating oil concentrate composition of claim 100 wherein said copolymer of (ii) is comprised of ethylene, propylene and 5-ethylidene-2-norbornene.

104. The lubricating oil concentrate composition of claim 101 wherein said copolymer of (ii) is comprised of ethylene, propylene and 5-ethylidene-2-norbornene.

105. The lubricating oil concentrate composition of claim 54 wherein (ii) is present in an amount comprising from about 0.5 to about 20 weight percent thereof.

106. The lubricating oil concentrate composition of claim 105 wherein (ii) is present in an amount comprising from about 0.5 to about 12 weight percent thereof.

* * * * *